US005595118A

United States Patent [19]

Villaverde, Sr. et al.

[11] Patent Number: 5,595,118

[45] Date of Patent: Jan. 21, 1997

[54] DRYING APPARATUS FOR A DRY OFF-SET PRINTING PRESS HAVING AN ULTRA-VIOLET LAMP ASSEMBLY

[75] Inventors: Fernando Villaverde, Sr.; Fernando Villaverde, Jr., both of Piscataway, N.J.

[73] Assignee: F & L Machinery Design, Inc., Edison, N.J.

[21] Appl. No.: 543,452

[22] Filed: Oct. 16, 1995

[51] Int. Cl.[6] ..... B41F 35/06

[52] U.S. Cl. ..... 101/424.1; 101/424.2; 34/277; 34/278

[58] Field of Search ..... 101/424.1, 424.2, 101/487, 488; 34/277, 278, 275

[56] References Cited

U.S. PATENT DOCUMENTS

| | | | |
|---|---|---|---|
| 3,826,014 | 7/1974 | Helding | 34/1 |
| 3,930,318 | 1/1976 | Stelter et al. | 34/4 |
| 4,037,329 | 7/1977 | Wallace | 34/4 |
| 4,048,916 | 9/1977 | Silverman et al. | 101/40 |
| 4,644,899 | 2/1987 | Glaus | 118/642 |
| 5,048,198 | 9/1991 | Burgio, Jr. | 34/4 |
| 5,097,136 | 3/1992 | Meyer et al. | 250/492.1 |
| 5,129,161 | 7/1992 | Szarka | 34/4 |
| 5,204,534 | 4/1993 | Dubuit | 250/492.1 |
| 5,343,629 | 9/1994 | Rae | 34/278 |

*Primary Examiner*—Edgar S. Burr
*Assistant Examiner*—Anthony H. Nguyen
*Attorney, Agent, or Firm*—Ezra Sutton

[57] ABSTRACT

A dryer apparatus in combination with a printing press for drying printed matter and coatings on containers as they are received from the printing press, including a shroud assembly for housing a shutter assembly and a UV lamp assembly for drying printed matter and coatings on the containers. The UV lamp assembly includes a housing, a UV lamp mounted in the housing, and a UV reflector mounted in the housing for directing UV light in a light path toward the containers; and guide rails and guide tracks for moving the UV lamp assembly between an operational position in the shroud assembly and a non-operational position outside the shroud assembly to allow the UV lamp to be serviced or changed. The shutter assembly includes a clam-type shutter, a shutter shaft for pivotally mounting the shutter located inside the shroud assembly, and a piston-cylinder mounted outside the shroud assembly for pivotally moving the shutter between a light-blocking position between the UV lamp and the containers, and a light-drying position wherein the shutter is moved out of the light path of the UV lamp to dry the containers. There is a second embodiment having dual UV lamp assemblies and dual shutter assemblies which operate in cooperation with each other within a shroud assembly.

24 Claims, 19 Drawing Sheets

DRYING APPARATUS FOR A DRY OFF-SET PRINTING PRESS HAVING AN ULTRA-VIOLET LAMP ASSEMBLY

FIELD OF THE INVENTION

This invention relates to a drying apparatus having an ultra-violet lamp assembly which is used for the curing and drying of ink and/or varnish for dry off-set printing presses. More particularly, this drying apparatus uses a clam-type shutter component being adjustable, readily accessible for repair and maintenance; and is utilized for the drying of printed indicia on containers and cups of various sizes and shapes.

BACKGROUND OF THE INVENTION

At present, drying apparatus having an ultra-violet (UV) lamp assembly uses a slide-type shutter component for the drying of ink, varnish, or ink and varnish on cups and containers. The UV lamp assembly is the essential and main component for drying of ink or varnish in dry off-set printing presses.

The drawbacks of present UV lamp assemblies are numerous. The most critical problem is the excessive leaking of high intensity UV light which is injuring the operator's eyesight because of inefficient and non-adjustable shrouding components for the slide-type shutter assembly within the UV lamp assembly.

Another critical problem occurring in the UV lamp assembly is the shroud housing for drying gets excessively hot. This is due to insufficient air flow from the mounted fans within the shroud housing, as the fans do not have sufficient space to cause a cooling air flow effect. This excessive heat causes the cups, tubes, or containers being dried to distort and/or melt. Also, due to the excessive heat the UV lamps frequently burn out at the rate of three (3×) times per week because of insufficient cooling of the UV lamp fixture.

Another disadvantage of the present UV lamp assembly is that the component parts of the assembly are very large and cumbersome; and in its assembled form, it is very difficult to perform any repair, or maintenance, or replacement of parts, as the UV lamp assembly in general and the UV lamps in particular are for the most part inaccessible for a quick repair. Also, the UV lamps within the UV lamp assembly are quite susceptible to breaking due to the vibrations of the shroud housing and printing press machinery.

Finally, sight plates for use in checking the operational status and condition of the printed tube which is adjacent to the shutter assembly can not be used because of the excessive leaking of the UV light to the operators.

There remains a need for a new and improved drying apparatus having a clam-type shutter assembly and UV lamp assembly that is sturdy, larger, adjustable, UV light leakproof, well-cooled, vibration free and easily accessible for maintenance. This shutter assembly and UV lamp assembly would also be utilized for various tube, cup, and container sizes and shapes; and be readily adaptable to different types of dry off-set printing presses.

DESCRIPTION OF THE PRIOR ART

Drying apparatus having an ultra-violet light lamp assembly and a shutter component for a printing press, silk screening device, and the like of various designs have been disclosed in the prior art. For example, U.S. Pat. No. 4,048,916 discloses an apparatus for decorating cylindrical containers having a compact-curing section. The curing section includes several subassemblies having a liquid-cooled main reflector, a plurality of UV lamps, a liquid-cooled shutter and air-cooled chambers wherein the UV lamp terminals are disposed. This patent does not use a clam-type shutter nor does the curing section have a readily removable UV lamp assembly as in the present invention. The present invention has a different configuration for the dryer housing than this prior art patent.

U.S. Pat. No. 5,048,198 discloses a shutter system having UV lamps incorporated therein for shielding a coated substrate during a radiation-curing process. The shutter system consists of a cantilevered shutter plate, a double-acting pneumatically operated cylinder with piston rod and guide-support rods having bearing assemblies. The shutter plate is a solid, substantially flat plate, unlike the present invention where the shutter assembly has a curved shape to shield the UV reflectors and UV lamps. This prior art patent shows the shutter plate moving in a left to right motion in a horizontal plane. This patent does not disclose the use of a readily removable UV lamp assembly nor the use of the clam-type shutter assembly of the present invention.

U.S. Pat. No. 5,343,629 discloses an air-cooled, ultra-violet dryer housing comprising UV lamps mounted within a reflector. The shutter blades are pivotally mounted on a shaft which rotates the shutter blades by a rotary actuator. This patent does not disclose the use of a readily removable UV lamp assembly nor the use of the clam-type shutter assembly of the present invention.

U.S. Pat. No. 5,129,161 discloses a UV light shuttle cover apparatus used for screen printing drying. As an article is being dried, it moves into position under a UV lamp, and the UV shuttle cover plates slide open in a timed sequence with the movement of the article so that the UV light bathes and dries the article. When the article moves away from the UV light source, the shuttle cover plates slide together to block the UV light rays from escaping into the work environment. This prior art patent does not disclose the use of a readily removable UV lamp assembly nor the use of the clam-type shutter assembly of the present invention.

These prior art patents do not show the UV lamp assembly being removable from the dryer housing for easy replacement of the UV lamp, and replaceable with another UV lamp assembly in the dryer housing while the UV lamp bulb is being changed. Also, the prior art patents do not show the shutter assembly completely movable out of the UV lamp reflecting area during drying to avoid heat and warping of the shutter assembly which prolongs the life of the shutter assembly.

Accordingly, it is an object of the present invention to provide for a drying apparatus having an UV light shutter assembly that has a clam-type shutter which is movable, accessible, and UV light leakproof for the drying of printed indicia or coatings on cups, tubes, or containers for dry off-set printing presses.

Another object of the present invention is to provide for a drying apparatus having an UV lamp assembly having the primary benefits of increased efficiency due to lower maintenance, less down time, and less labor costs for repair and replacement of broken UV lamps; and for change-overs to different container and cup sizes.

Another object of the present invention is to provide for a shroud assembly or housing which eliminates any UV light leakage from the UV lamp assembly and which reduces eyesight injury and fatigue of an operator. Thus, the UV lamp assembly is essentially leak proof and does not emit any UV light from the shroud assembly.

Another object of the present invention is to provide for a shroud assembly that is larger, sturdier, not cumbersome, as all of its component parts are readily accessible for easy maintenance, repair, or replacement of broken parts.

Another object of the present invention is to provide for a shutter assembly with an improved mounting arrangement and made of a better quality and heavier gauge steel thereby eliminating machine vibrations which further reduces UV light bulb breakage.

Another object of the present invention is to provide for a UV blower fan located outside of the shroud assembly and adjustable for intensity of air flow to allow the UV fan to dissipate the heat caused by UV lamp because the shroud housing is larger and the air flow is blowing along the length of the UV lamp. This design allows the UV lamp to last a longer time before burning out.

Another object of the present invention is to provide for a drying apparatus having an UV lamp assembly that easily slides out of the shroud assembly for ease of maintenance and repair of the UV lamp, UV blower fan, UV assembly control box, shutter arm, shutter light shields, etc.

A further object of the present invention is to provide for a shroud assembly having a sight cover plate that is easily removable for the visual inspection of the drying process without injury or damage to the operators' eyesight.

A still further object of the present invention is to provide a drying apparatus that is simple to manufacture and assemble; and is also more cost efficient in operational use than previous drying apparatus.

SUMMARY OF THE INVENTION

The present invention provides for a dryer apparatus in combination with a printing press for drying printed matter and coatings on containers as they are received from the printing press, including a shroud assembly for housing a shutter assembly and a UV lamp assembly for drying printed matter and coatings on the containers. The shroud assembly includes a housing having a first opening formed therein through which the UV lamp moves between an operational position in the housing and a non-operational position outside of the housing, and a passageway extending through the housing through which the containers pass to be dried.

The UV lamp assembly includes a housing, a UV lamp mounted in the housing, and a UV reflector mounted in the housing for directing UV light in a light path toward the containers; and guide rails and guide tracks for moving the UV lamp assembly between an operational position in the shroud assembly and a non-operational position outside the shroud assembly to allow the UV lamp to be serviced or changed. The guide rails are mounted on the UV lamp housing and the guide tracks are mounted within the shroud assembly, such that the guide rails are used for engaging the guide tracks for moving the UV lamp assembly between the operational and non-operational positions. The UV lamp assembly further includes electrical connection means having an electrical conduit connected to a power source to supply electrical power to the UV lamp assembly; and the electrical conduit is connected to and movable with the UV lamp assembly. The UV lamp also includes a blower fan connected to a cooling tube for transferring cooled air to the UV lamp assembly.

The shutter assembly includes a clam-type or U-shaped shutter, a shutter shaft for pivotally mounting the shutter located inside the shroud assembly, and a piston-cylinder device mounted outside the shroud assembly for pivotally moving the shutter between a light-blocking position between the UV lamp and the containers, and a light-drying position wherein the shutter is moved out of the light path of the UV lamp to dry the containers. The shutter assembly shaft for pivotally mounting the shutter includes bearings mounted on the inside walls of the shroud assembly. The piston-cylinder device includes a pivot arm for activating the shutter shaft, such that the shutter shaft moves the clam-type shutter between a light-blocking position and a light-drying position. The shutter is U-shaped in cross section and has a light-blocking shutter wall for moving between the UV lamp and the containers, and a pair of legs connected to the shutter shaft for pivotally mounting the U-shaped shutter.

There is a second embodiment having dual and identical UV lamp assemblies and dual and identical shutter assemblies which operate in cooperation with each other within a single shroud assembly. The principle function of the second embodiment is to provide the ultra-violet light for drying of protective coatings, such as lacquer, shellac, or paint on tubes, cups, or containers. The larger shroud assembly of this second embodiment and the double UV lamps provide a higher intensity of heat for drying of the containers for a longer period of time. In all other respects, the UV lamp assembly and shutter assembly of the second embodiment perform in the same manner as in the first embodiment.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE FIRST EMBODIMENT

Overview of First Embodiment 10

Figure 1:
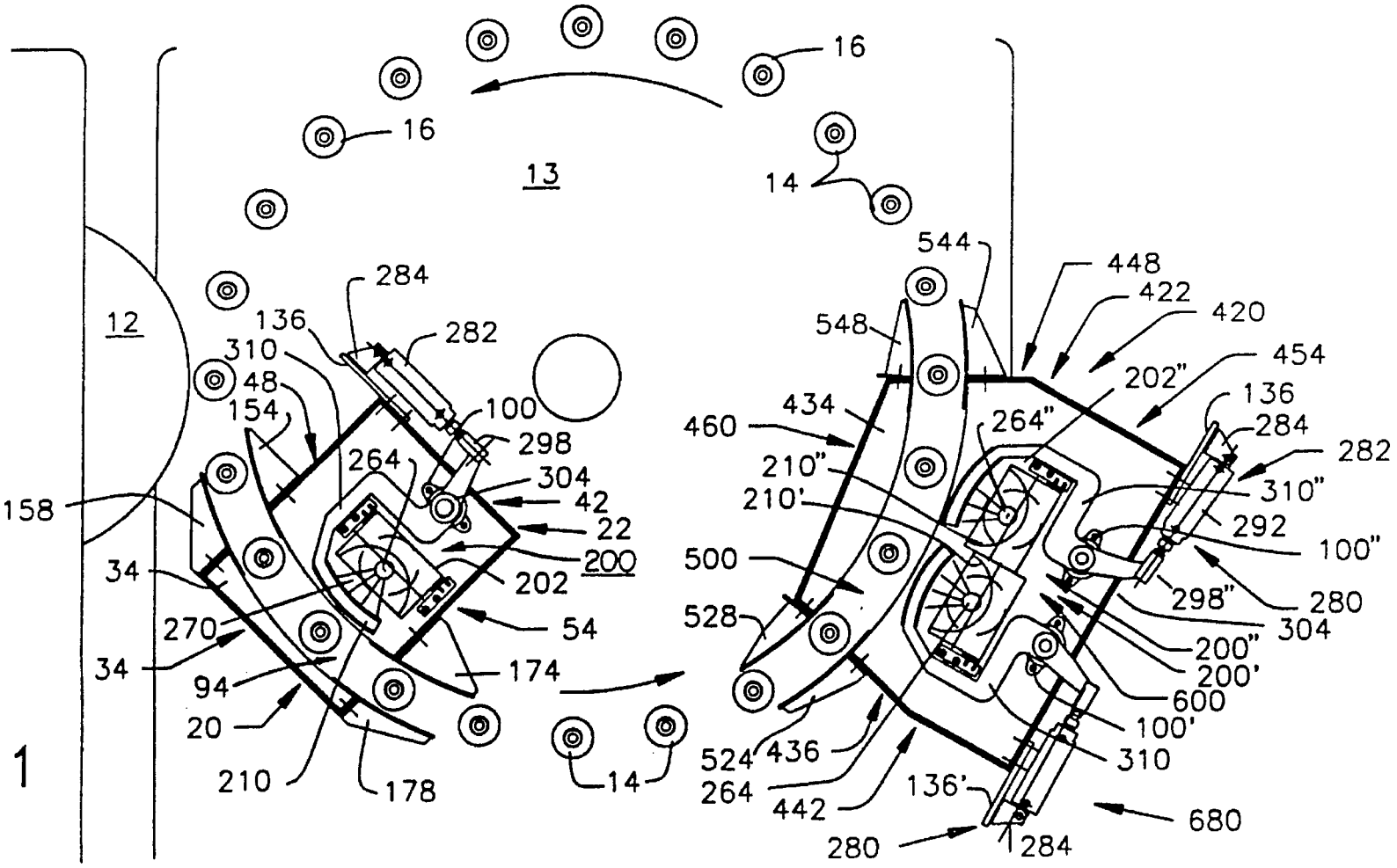
FIG. 1 is a vertical sectional front view of the first and second embodiments of the drying apparatus for a printing press of the present invention showing the shroud assembly, the UV lamp assembly and the shutter assembly and their interaction with a plurality of rotatable mandrels.

The drying apparatus 10 and its component parts of the preferred and alternate embodiments of the present invention, are used in conjunction with a dry off-set printing press 12, having an indexing mandrel dial component 13 for holding twenty-four (24) rotatable mandrels 14. The indexing mandrel dial 13 provides a clock face for rotating the mandrels 14 in a proper radius in moving through the first and second embodiments of the present invention, as represented in detail by FIGS. 1 through 17. The drying apparatus 10, as shown in FIGS. 1 to 8, comprises a shroud assembly 20 for housing the two major component assemblies and parts therein. These two major component assemblies include a UV lamp assembly 200 for drying of the printed indicia 18 on the outside wall of a container 16; and a shutter assembly 280 for keeping the UV lamp assembly 200 ON when there are mechanical problems due to breakdowns, jams, or printing press maintenance, such that the shutter component 316 is in a closed shutter position 322. This shutter assembly 280 enables UV lamp 264 to be ON without exposing UV light to container 16, as the shutter 316 is in a closed position, thus allowing the correction by an operator of any type of problem that has occurred. If the operator had to shut down the UV lamp assembly 200, it would take at least 15 to 20 minutes to power-up the UV lamp ballasts (not shown in drawings), every time there was a problem. This time for powering-up of those ballasts would curtail a given production run severely. Also, when the shutter shield component 316 is in the closed position 322, this prevents the UV light 270 from UV lamp 264 from possibly melting the tube, cup, or container 16 and/or burning off the printed indicia 18.

Shroud Assembly 20

The shroud assembly 20, as depicted in FIGS. 1 to 4, 5A and 5B, includes a rectangular metal shroud housing 22 having an integrally attached front wall 24, rear wall 30, left sidewall 36, right sidewall 42, top wall 48 and bottom wall 54. Front wall 24 includes outside and inside surfaces 26 and 28 having openings 60, 62, 64, 66 for the insertion therein of the UV lamp assembly 200, the upper flange bearing 68, and flange connecting bolts 70, respectively. Front wall 24 further includes threaded mounting openings 72, 74, 82, and 84 for fixedly connecting upper and lower guide rails 76 and 86 to the inner wall surface 28 via connecting bolts 92. Guide rails 76 and 86 include inside and outside U-shaped channel tracks 78, 80, 88, and 90 for sliding the UV lamp assembly 200 in and out of the shroud housing 22.

Rear wall 30 includes outside and inside surfaces 32 and 34 having an arc shaped cut-out opening 94 for the passage of the rotatable mandrels 14 through arc 94, and threaded openings 96 and 98 for mounting of the lower flange bearing 100 to the inside wall surface 34 via connecting bolts 70. Rear wall 30 further includes threaded mounting openings 102, 104, 106, and 108 for fixedly connecting upper and lower guide rails 76 and 86 to the inner wall surface 34 via connecting bolts 92.

Left sidewall 36 includes outside and inside surfaces 38 and 40 having an opening 110 for the sight cover plate 112 and a plurality of threaded mounting openings 116 for fixedly connecting the sight cover plate 112 to the outside surface 38. The sight cover plate 112 includes a plurality of mounting openings 114 for attaching the sight cover plate 112 to the outside surface 38 via connecting bolts 118 in the plurality of threaded mounting openings 116 of left sidewall 36.

Right sidewall 42 includes outside and inside surfaces 44 and 46 having an opening 120 for the exhaust cover plate 122 and a plurality of mounting openings 130 for fixedly connecting the exhaust cover plate 122 to the outside surface 44. The exhaust cover plate 122 includes a plurality of mounting openings 128 for attaching the exhaust cover plate 122 to the outside surface 44 via connecting bolts 118 in the plurality of threaded mounting openings 130 of right sidewall 42. The exhaust cover plate also includes a centrally located exhaust hole opening 124 being four (4") inches in diameter having an integrally attached exhaust hose connector 126 for attaching of an exhaust hose 127 to exhaust out the hot air being generated by UV lamp assembly 200. Right sidewall 42 further includes a plurality of threaded upper and lower mounting openings 132 and 134 for fixedly connecting the pivot bracket mounting plate 136 to the outside surface 44. The pivot bracket mounting plate 136 includes front and rear wall surfaces 144 and 146 having a plurality of upper and lower mounting openings 138 and 140 for attaching the plate 136 to the outside surface 44 via connecting bolts 142 in the plurality of threaded mounting openings 132 and 134. The mounting plate 136 also includes a pair of threaded mounting openings 148 for fixedly connecting the pivot bracket 284 to the front wall surface 144 via connecting bolts 142.

Top wall 48 includes outside and inside surfaces 50 and 52 having a rectangular cut-out opening 150 for the passage of the rotatable mandrels 14 through rectangular opening 150; and a plurality of threaded mounting openings 152 for the top front and rear UV light shields 154, 156, 158, and 160. The top front UV light shields 154 and 156 have a plurality of mounting openings 162 and 164 for attaching the shields 154 and 156 to the outside surface 50 via connecting bolts 118 in threaded openings 152. Conversely, the top rear UV light shields 158 and 160 have a plurality of mounting openings 166 and 168 for attaching the shields 158 and 160 to the outside surface 50 via connecting bolts 118 in threaded openings 152.

Bottom wall 54 includes outside and inside surfaces 56 and 58 having a rectangular cut-out opening 170 for the passage of the rotatable mandrels 14 through rectangular opening 150; and a plurality of threaded mounting openings 172 for the bottom front and rear UV light shields 174, 176, 178, and 180. The bottom front UV light shields 174 and 176 have a plurality of mounting openings 182 and 184 for attaching the shields 174 and 176 to the outside surface 56 via connecting bolts 118 in threaded openings 172. Conversely, the bottom rear UV light shields 178 and 180 have a plurality of mounting openings 186 and 188 for attaching the shields 178 and 180 to the outside surface 56 via connecting bolts 118 in threaded openings 172. The top and bottom UV light shields 154, 156, 158, 160, 174, 176, 178, and 180 protect the operator from any escaping UV light rays 270 when the UV lamp assembly 200 is on.

Figure 2:
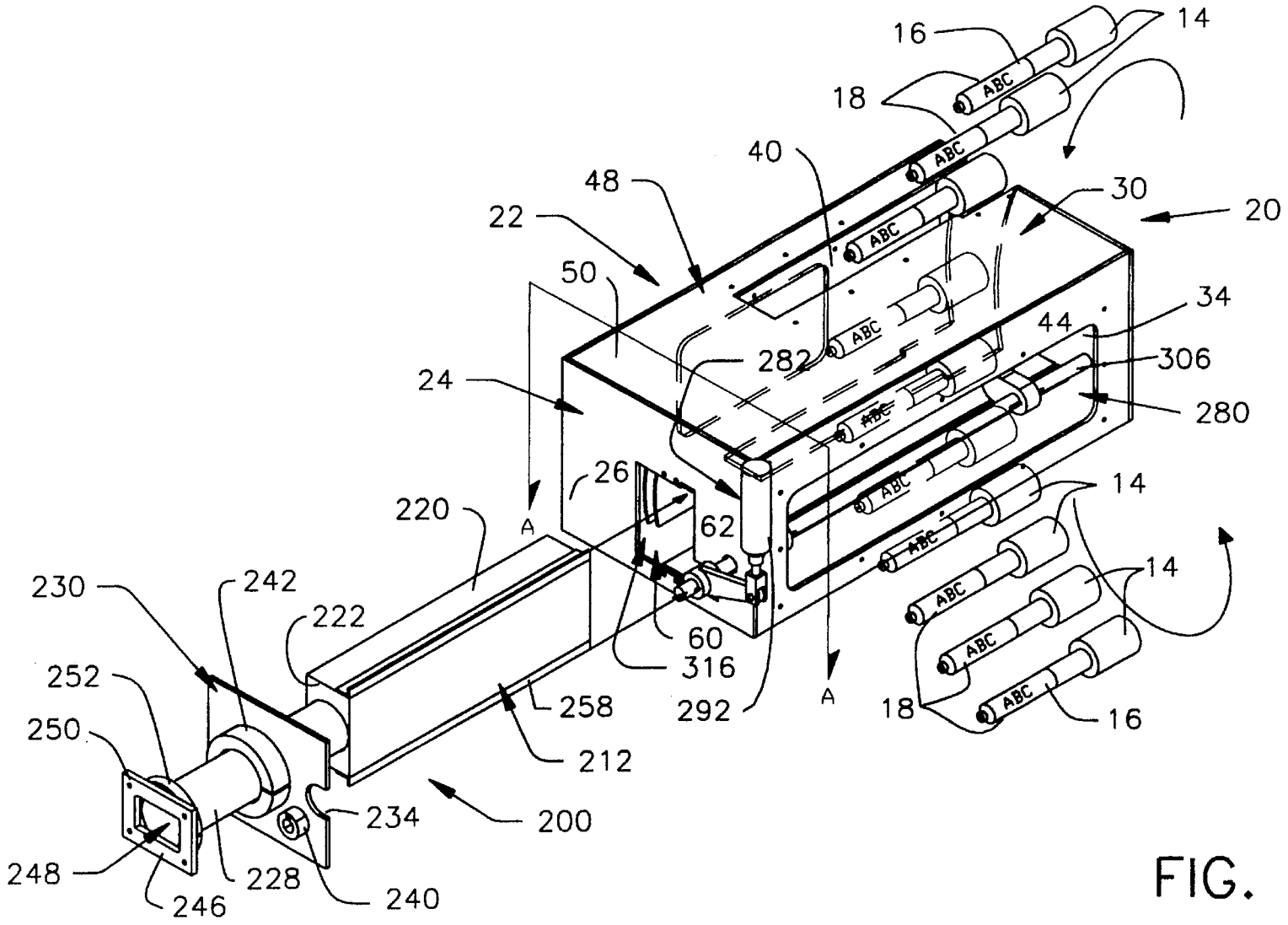
FIG. 2 is a front perspective view of the drying apparatus for a printing press for the first embodiment of the present invention showing the shroud assembly, the UV lamp assembly and the shutter assembly and its interaction with a plurality of rotatable mandrels.
Figure 3:
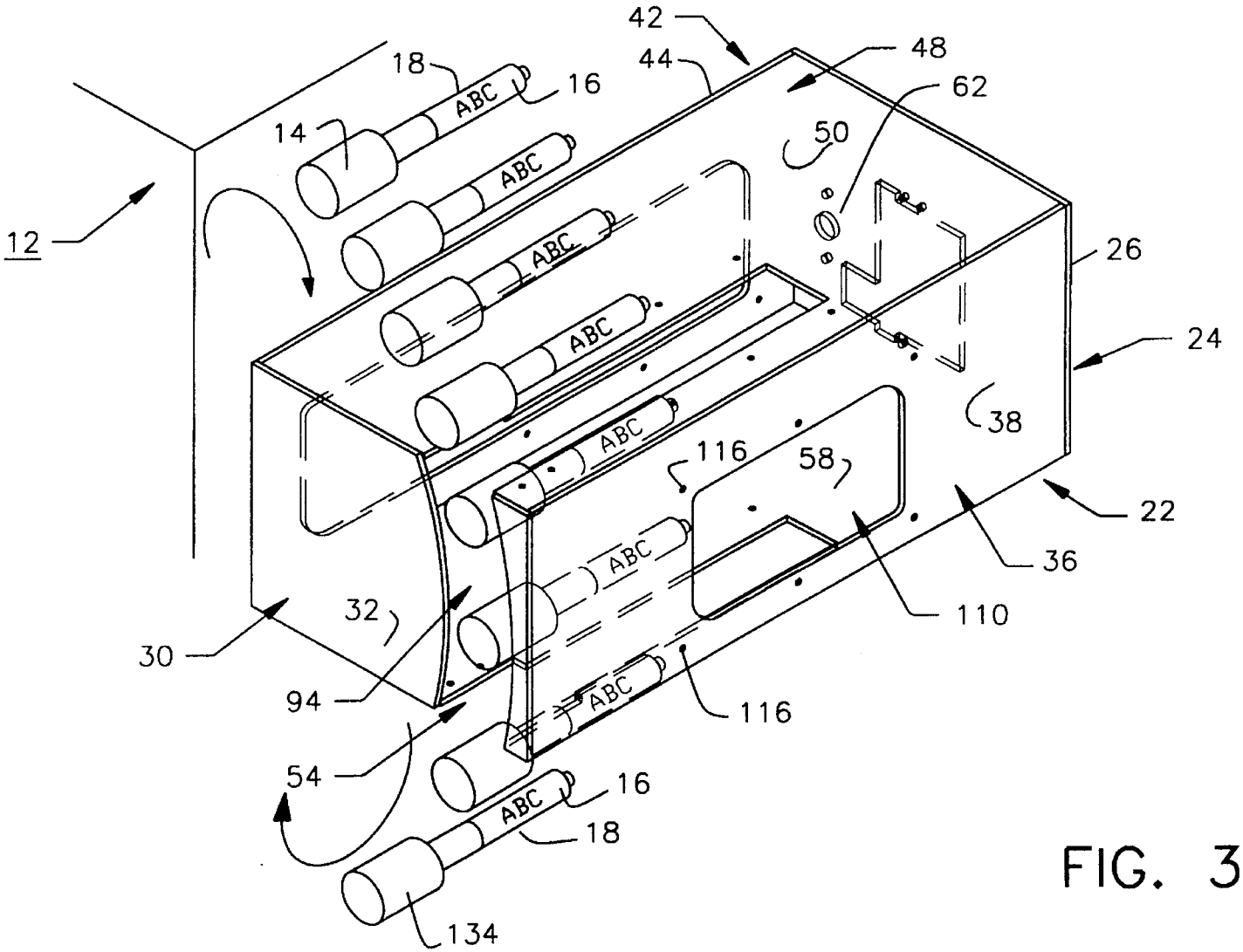
FIG. 3 is a rear perspective view of the drying apparatus for a printing press for the first embodiment of the present invention showing the plurality of rotatable mandrels passing through the top, rear and bottom walls of the shroud assembly during the drying process.
Figure 4:
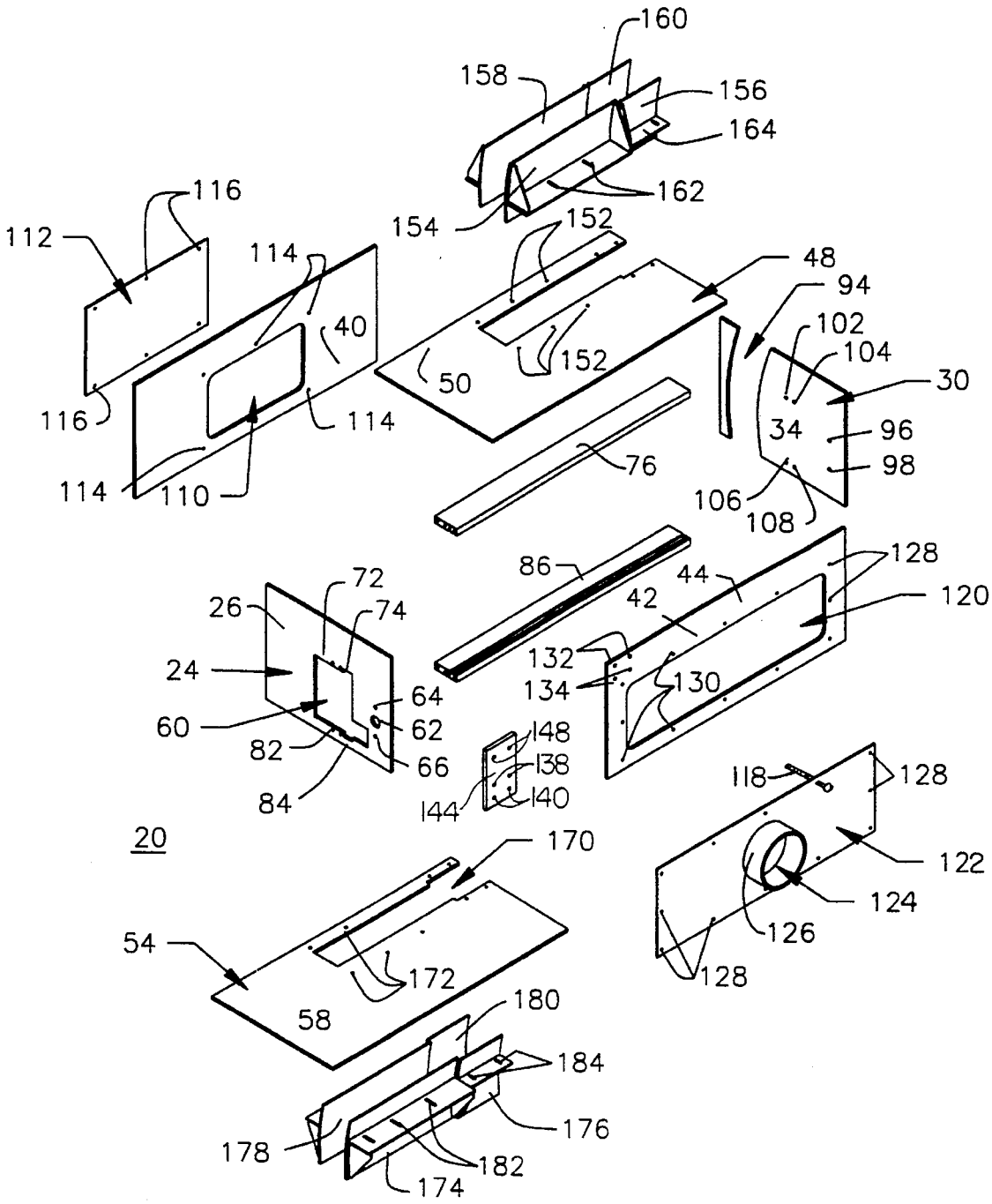
FIG. 4 is an exploded perspective view of the shroud assembly of the first embodiment showing its component parts therein.

The main function of shroud assembly 20, as shown in FIGS. 2 and 3 of the drawings, is to house and protect the UV lamp assembly 200 and protect against any escaping UV light rays 270. The sight cover plate 112 is solid and not transparent and provides for access to dryer 10 when UV lamp assembly 200 is off and when there is a mechanical problem, i.e. jamming of tubes. Further access to dryer 10 is available by the removal of the larger exhaust cover plate 122. Mounting plate 136 provides for the connecting point to the shutter assembly 280 and shroud assembly 20, as shown in FIG. 1 of the drawings.

UV Lamp Assembly 200

Figure 5A:
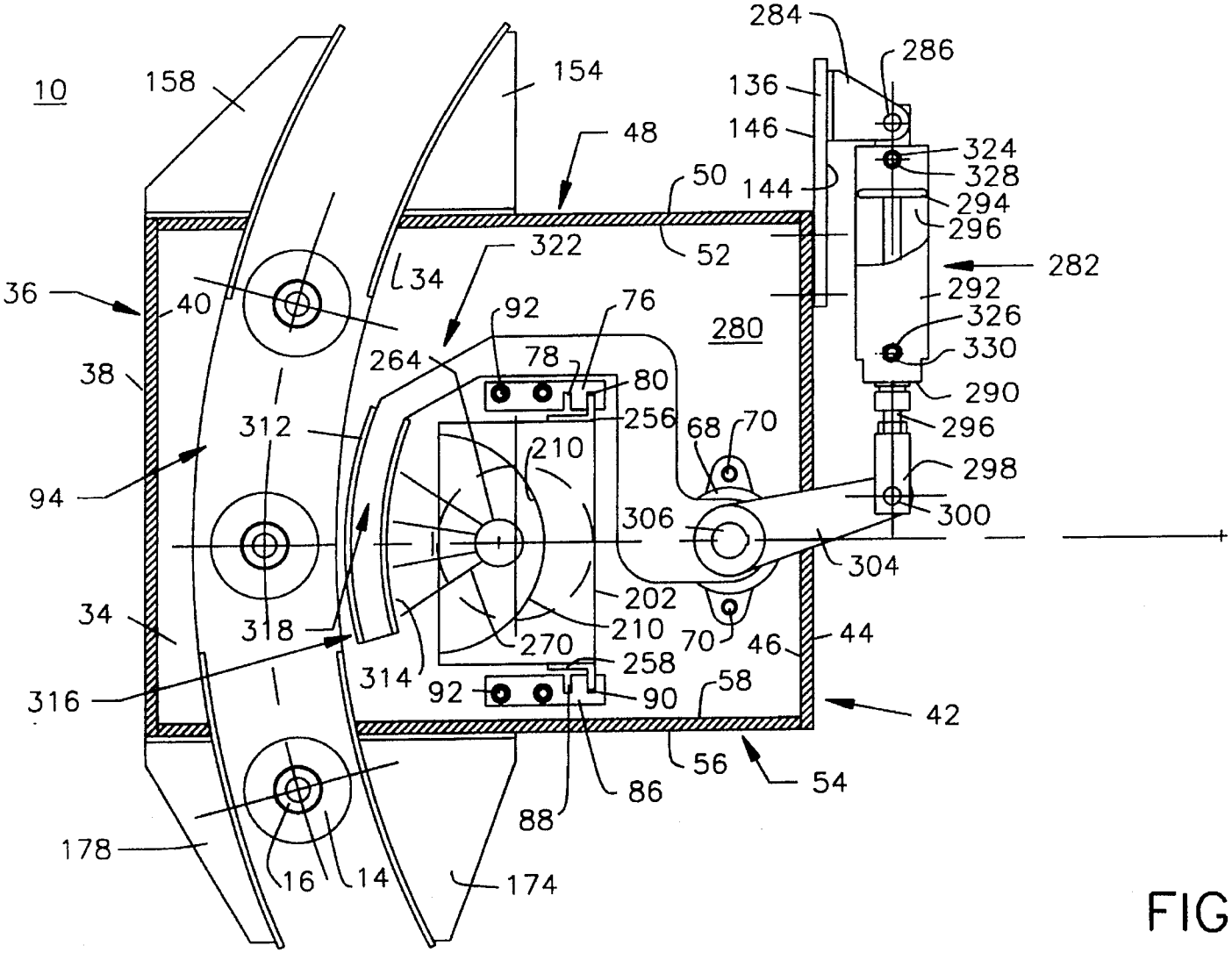
FIG. 5A is a vertical sectional front view of the drying apparatus of the first embodiment, taken along the sectional line A—A of FIG. 2, showing the UV lamp assembly, and shutter assembly contained within the shroud assembly which depicts the interaction of the assemblies in the closed position which prevents the drying process.
Figure 5B:
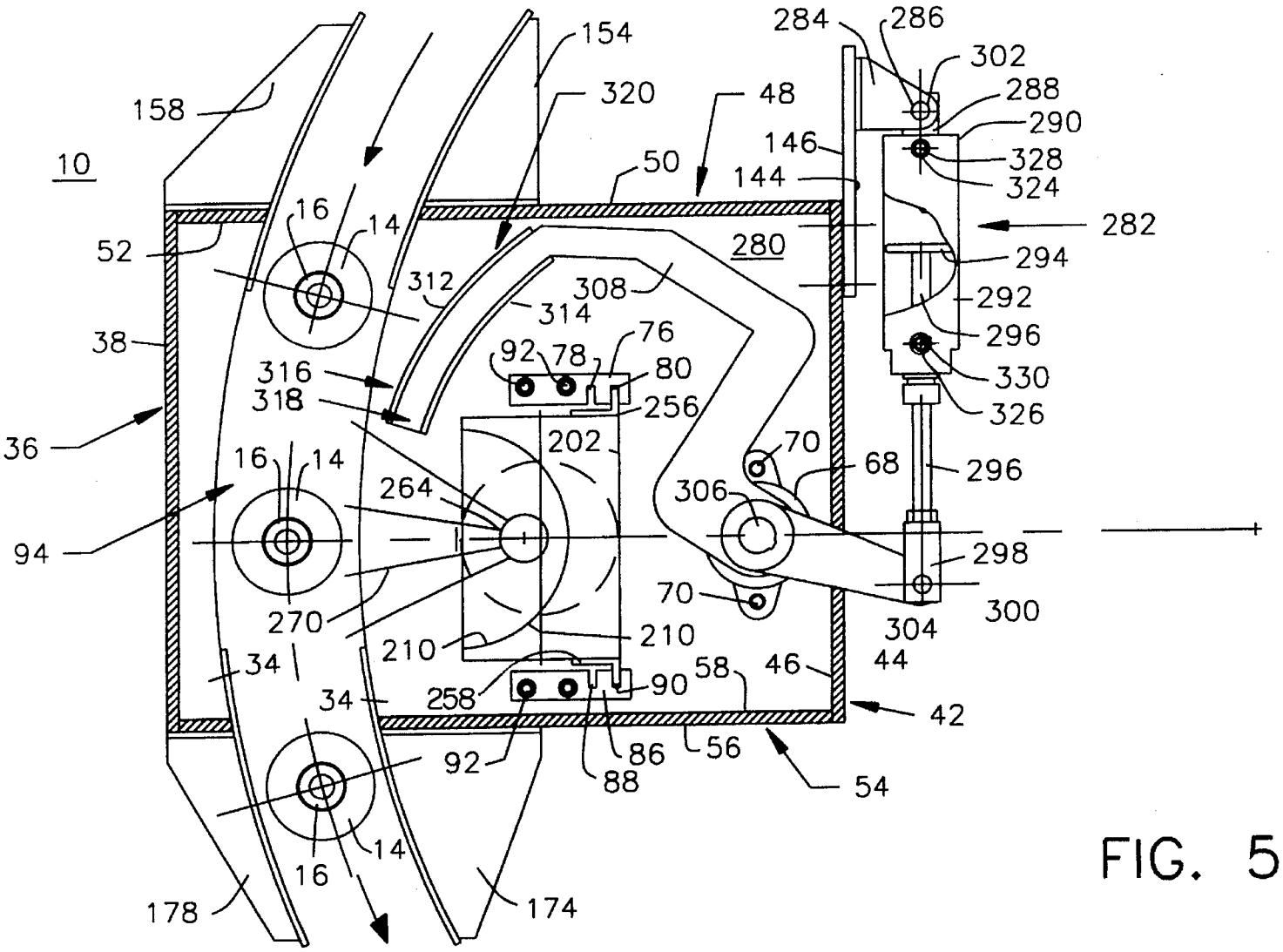
FIG. 5B is a vertical sectional front view of the drying apparatus of the first embodiment, taken along the sectional line A—A of FIG. 2, showing the UV lamp assembly, and shutter assembly contained within the shroud assembly which depicts the interaction of the assemblies in the opened position for drying of the tubes mounted on the plurality of rotatable mandrels passing through the shroud assembly.
Figure 6:
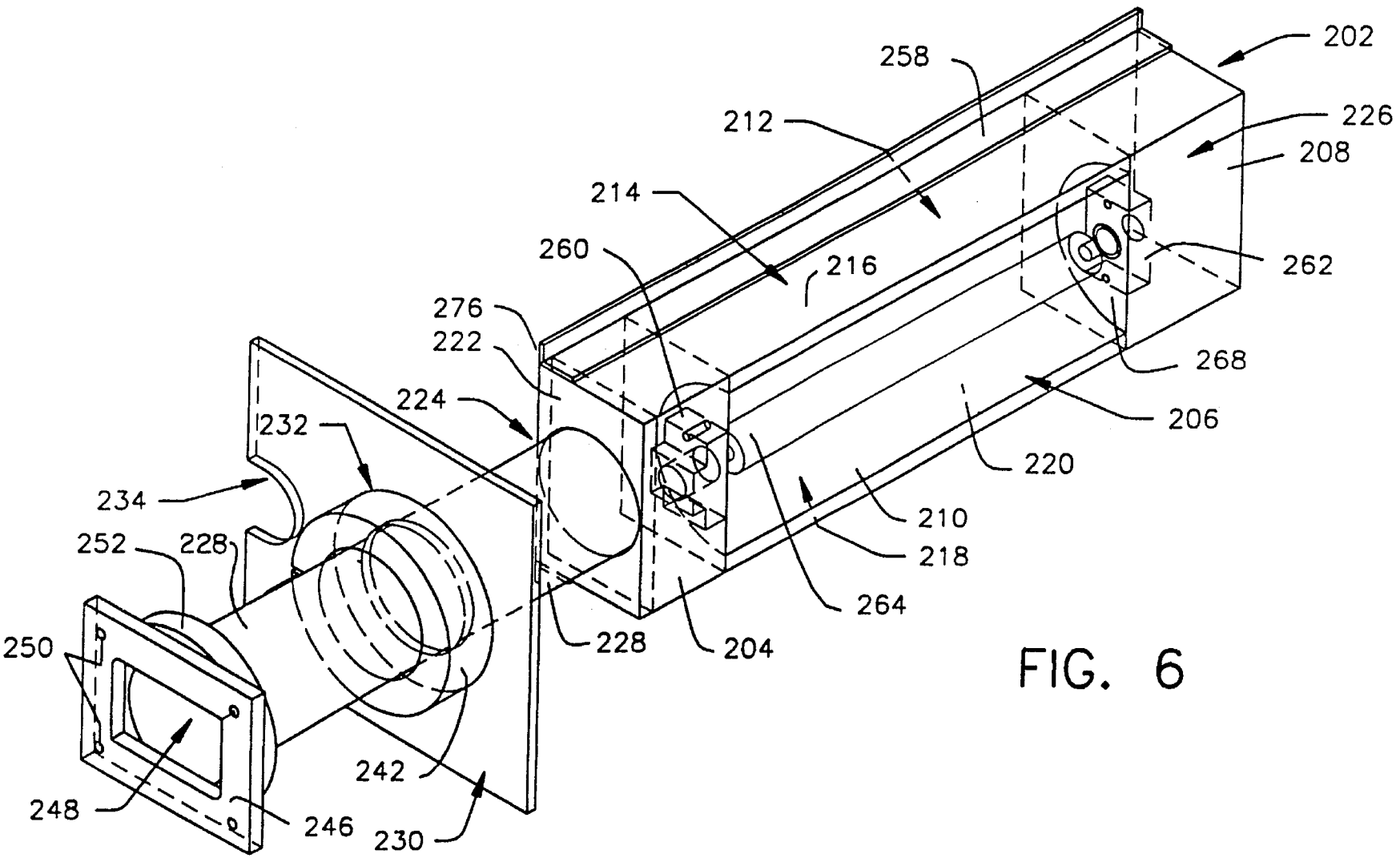
FIG. 6 is a front perspective view of the UV lamp assembly of the first embodiment showing its major component parts in an assembled condition.
Figure 7:
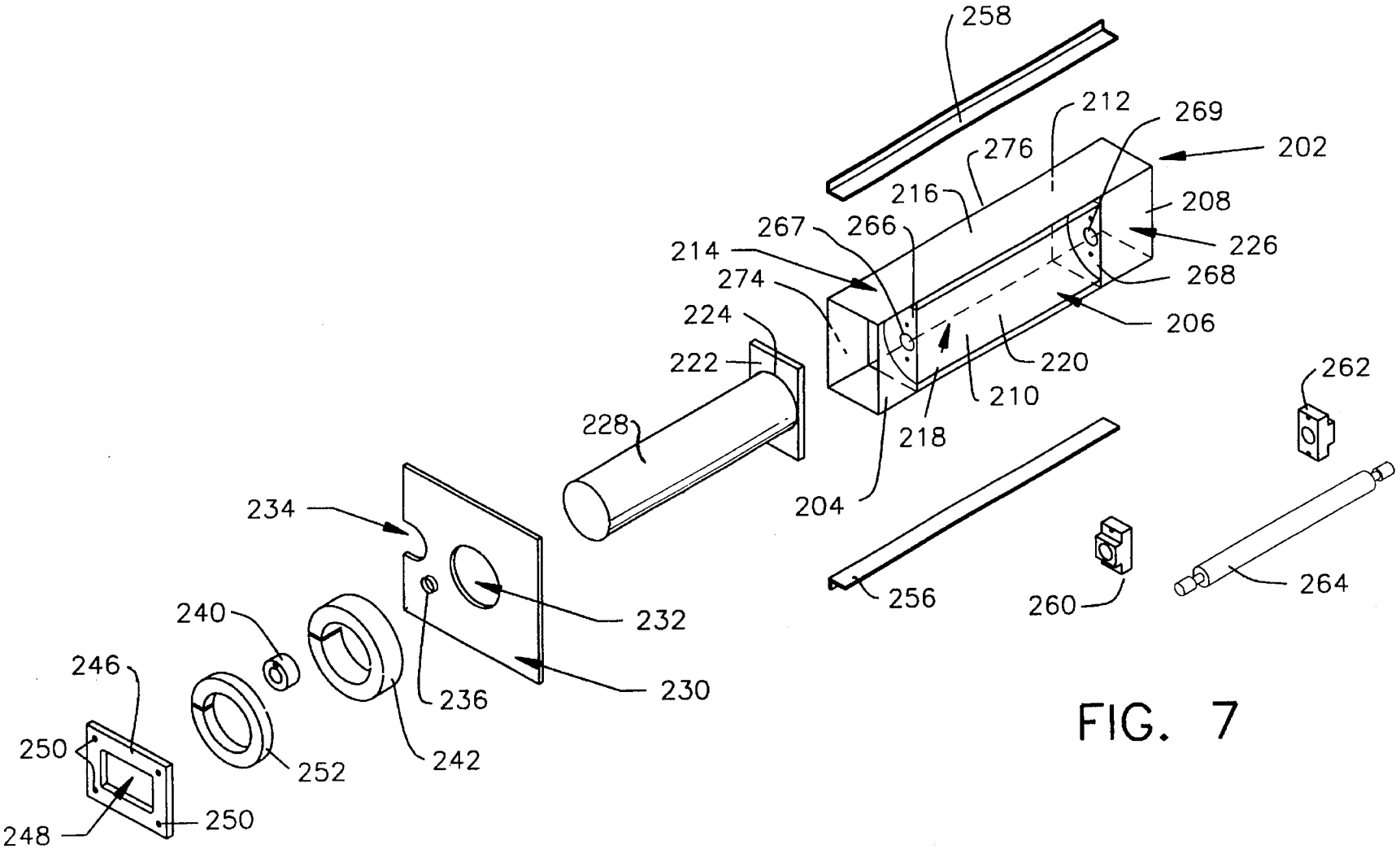
FIG. 7 is an exploded front perspective view of the UV lamp assembly of the first embodiment showing its component parts.
Figure 8:
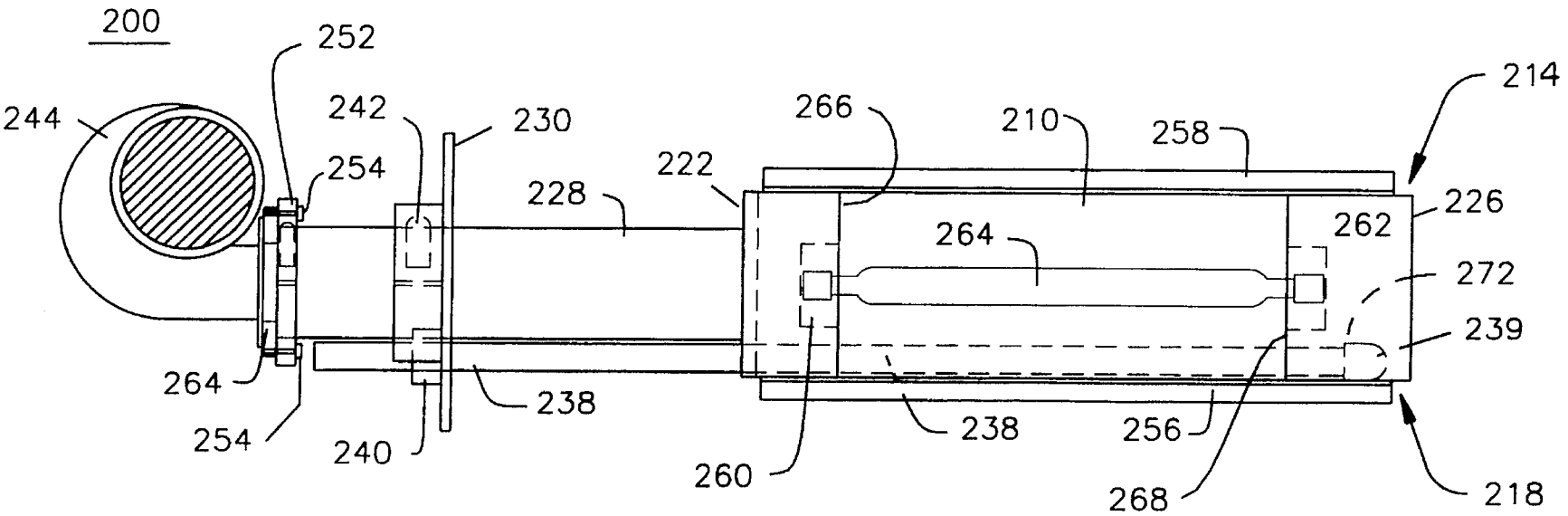
FIG. 8 is a front elevational view of the UV lamp assembly of the first embodiment showing the blower fan, cooling tube, UV lamp bulb and its other component parts in their assembled positions.
Figure 9:
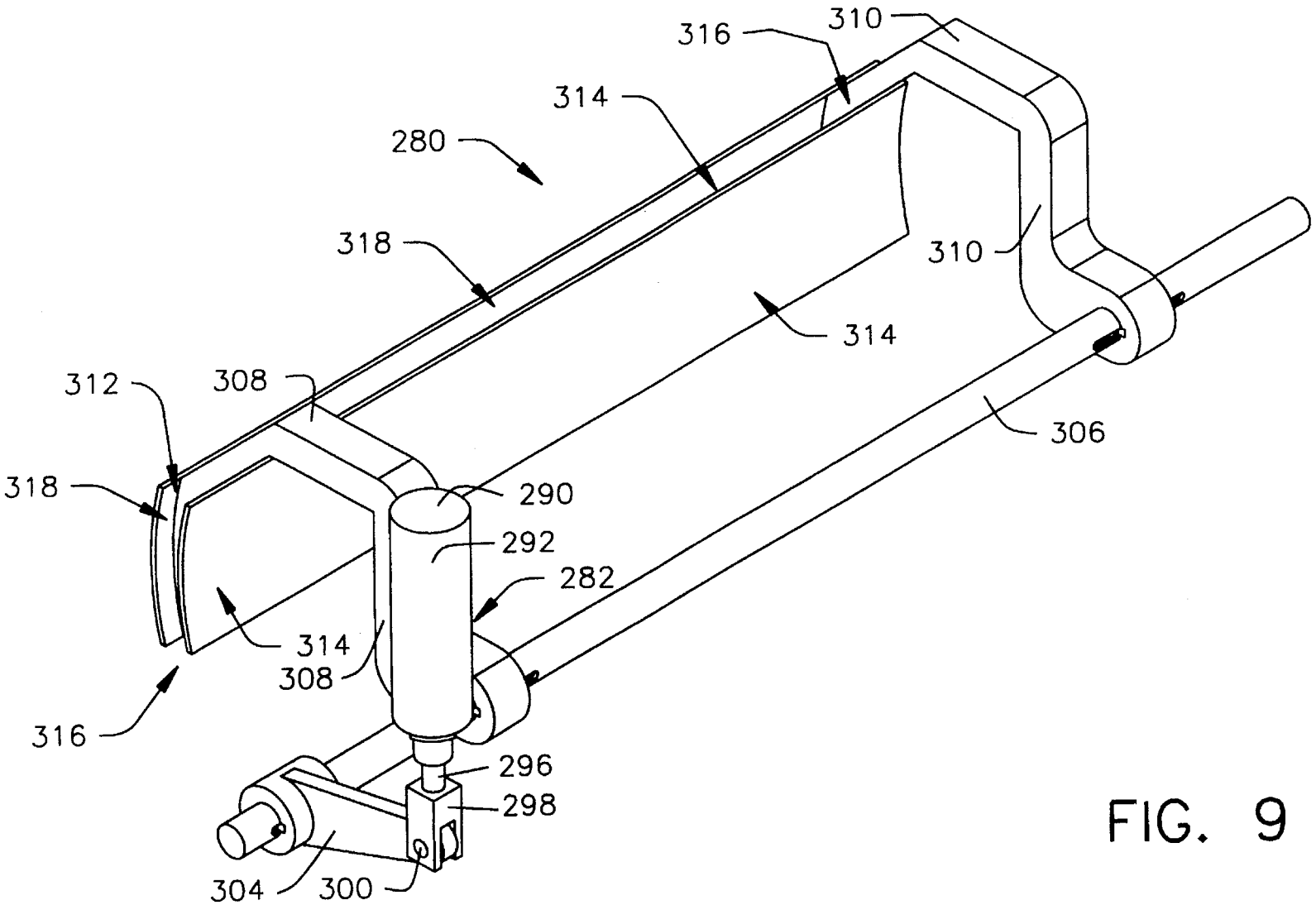
FIG. 9 is a rear perspective view of the shutter assembly of the first embodiment showing its major component parts in an assembled condition.
Figure 10:
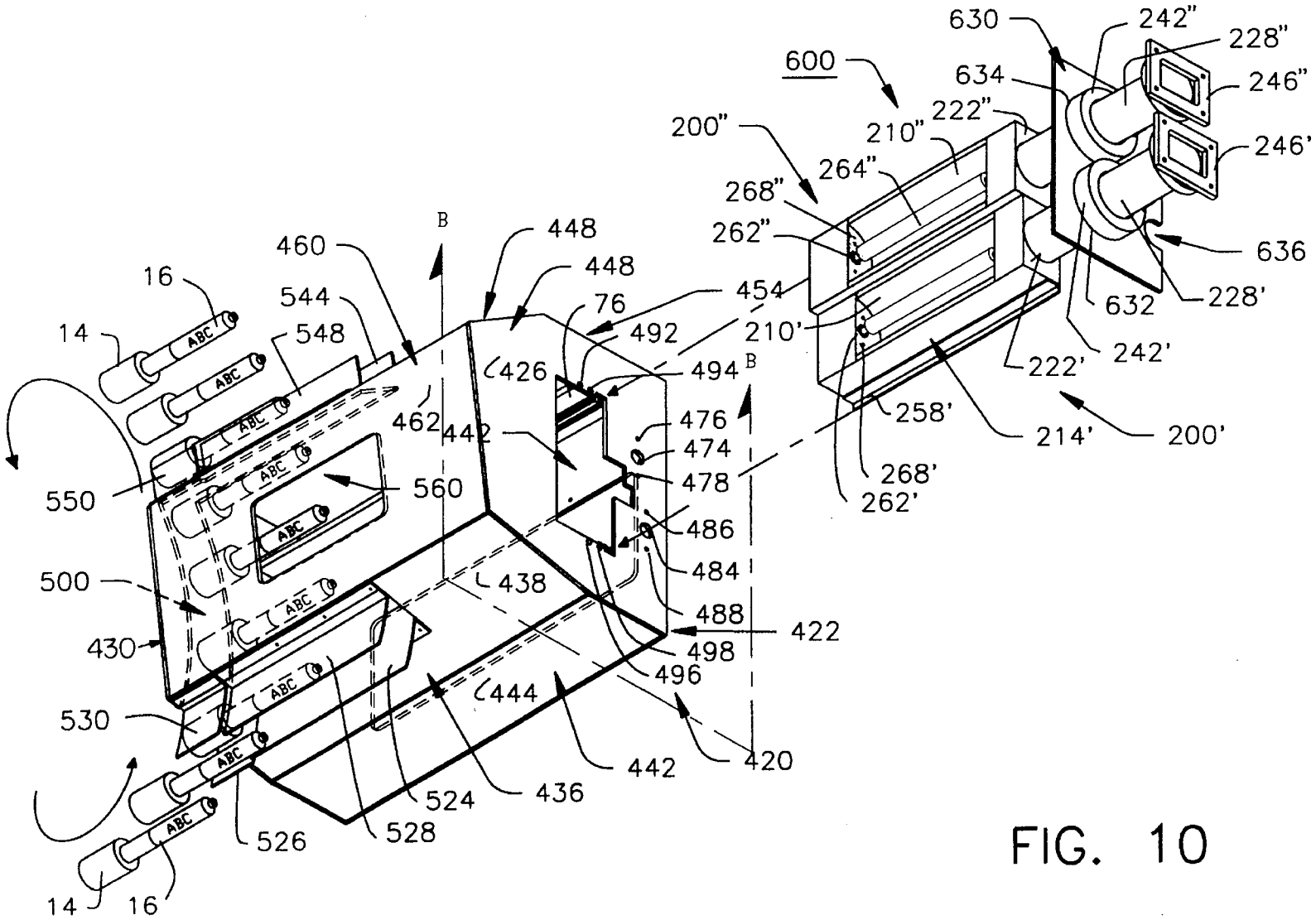
FIG. 10 is a bottom perspective view of the drying apparatus for a printing press for the second embodiment of the present invention showing the shroud assembly, the UV lamp assembly and the shutter assembly and its interaction with a plurality of rotatable mandrels.
Figure 11:
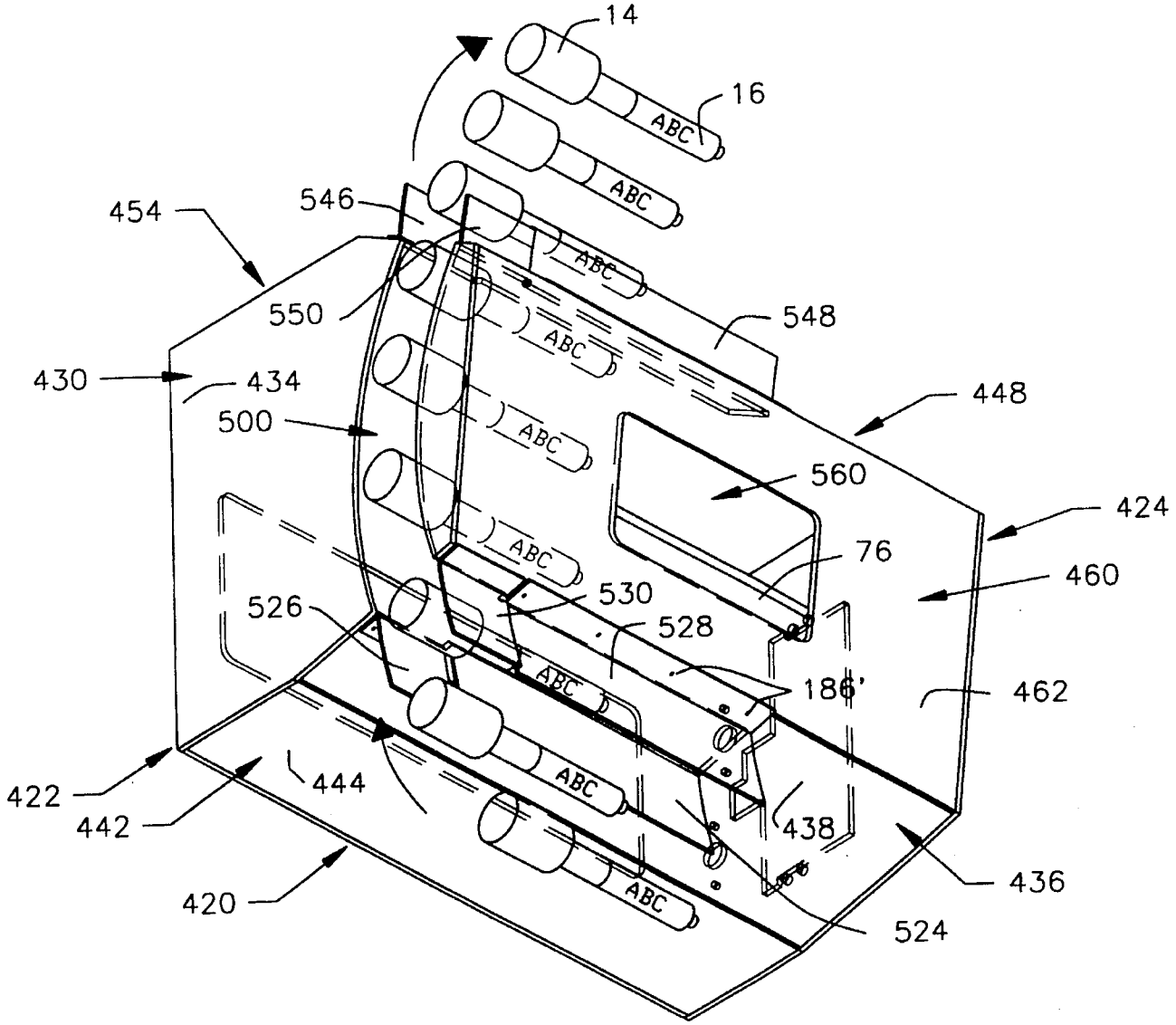
FIG. 11 is a rear perspective view of the drying apparatus for a printing press for the second embodiment of the present invention showing the plurality of rotatable mandrels passing through the top, rear and bottom walls of the shroud assembly during the drying process.
Figure 12:
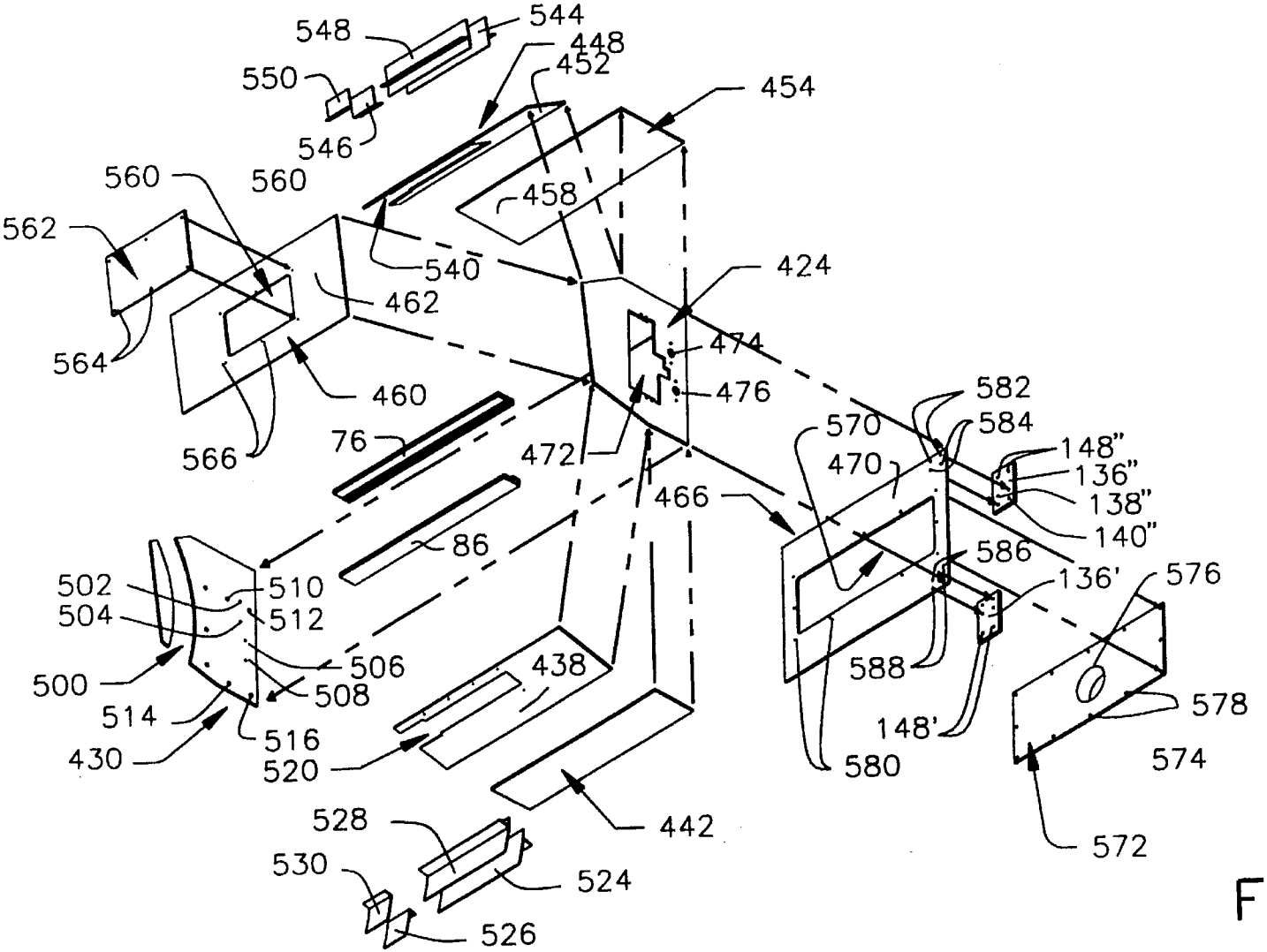
FIG. 12 is an exploded perspective view of the shroud assembly of the second embodiment showing its component parts therein.

The UV lamp assembly 200, as shown in FIGS. 5, 6, and 7, includes a 10 inch UV irradiator housing assembly 202 having integrally connected walls, being partial upper and lower front walls 204 and 208 having an opening 206 for an internal concave reflecting mirror 210. Reflecting mirror 210 has integrally attached upper and lower semi-circular reflecting walls 266 and 268 having circular openings 267 and 269 for receiving upper and lower UV lamp sockets 260 and 262 which receive a UV lamp 264. UV lamp 264 is a standard ten inch (10") long, 3 KW (kilowatt) powered conventional light for producing UV light 270 for drying. In addition, housing assembly 202 also includes a rear wall 212; sidewalls 214 and 218 having outer wall surfaces 216 and 220, respectively; a top wall 222 having a circular opening 224 being centrally located; and a bottom wall 226. A cylindrical cooling tube 228 is integrally connected to top wall 222 and is aligned with circular opening 224, as depicted in FIGS. 6 and 7.

Other UV lamp assembly 200 components include a front cover plate 230 having a cooling tube opening 232, a cut-out opening 234 for cylinder pivot arm 304, and an electrical conduit opening 236 for electrical conduit 238. Electrical conduit 238 is connectedly attached to conduit fitting 239. Conduit fitting 239 is connectedly attached to rear wall opening 272 of rear wall 212, such that fitting 238 is adjacent to bottom wall 226. Additionally, parts include a conduit cover 240, a cooling tube clamp 242, a blower fan 244, a blower plate 246, a blower plate clamp 252, and a pair of upper and lower L-shaped guide rail brackets 256 and 258.

Cooling tube clamp 242 holds in place the UV housing 202, once it has been positioned over the printed indicia 18 on tube 16 that is to be dried and/or cured. This cooling tube clamp 242 is only used for adjusting the UV housing 202 and once the UV housing 202 has been positioned, cooling tube clamp 242 clamps down on the cooling tube 228 which protrudes out from the UV housing 202. The cooling tube clamp 242 attaches to the front cover plate 230. The front cover plate 230 provides outlet hole and cut-out openings 232, 234, and 236 for the cooling tube 228, the cylinder pivot arm 304, and electrical conduit 238. Front cover plate 230 also provides protection from harmful UV light 270 leakage when in use to the operator. Blower plate 246 includes a blower fan opening 248 and a plurality of mounting openings 250, which connects blower fan 244 to blower plate 246 via connecting bolts 254. Guide rail brackets 256 and 258 are integrally attached to outer wall surfaces 216 and 220 of sidewalls 214 and 218 and are aligned with sidewall perimeter edges 274 and 276, as depicted in FIGS. 5 and 6.

The principle function of UV lamp assembly 200, as shown in FIG. 1, is to provide for the ultra-violet light 270 for drying of the printed indicia 18 on tube 16.

SHUTTER ASSEMBLY 280

The shutter assembly 280, as shown in FIGS. 1, 5A, 5B, and 9, includes an air compression cylinder 282 having a U-shaped pivot bracket 284 with a pair of pivot bracket mounting openings 285 for alignment and attachment to mounting plate openings 148 of mounting plate 136 via connector bolts 142; and a pair of pivot bracket arm opening 286 for attachment to pivot bracket arm 288 via a bracket bolt 302. Air compression cylinder 282 further includes the pivot bracket arm 288 being integrally connected to the compression cylinder headwall 290, a compression cylinder housing 292 having an internal piston cylinder head 294, a piston arm 296 having a rod clevis component 296 with a clevis pin 300 for attachment to the cylinder pivot arm 304. One end of the cylinder pivot arm 304 is fixedly connected to the rod clevis 298, and the other end is fixedly connected to the shield pivot shaft 306. This linkage allows the air compression cylinder 282 to pivot the shutter shield component 316 to an open shutter position 320 or a closed shutter position 322. This aforementioned linkage allows the air compression cylinder 282 to be outside of the shroud assembly 20, where it cannot fail due to heat. Compression cylinder housing 292 includes valve openings 324 and 326 having port inlet valves 328 and 330 attached thereto for the outstroke and instroke air, respectively, as shown in FIGS. 1, 5A, and 5B. Other component parts for shutter assembly 280 include a cylinder pivot arm 304 being connected with a shield pivot shaft 306 having an upper and lower shutter shield arms 308 and 310 with an outer and inner shutter shields 312 and 314 being attached to the aforementioned shield arms 308 and 310. The combination of the outer shutter shield 312 with the inner shutter shield 314 forms a shutter shield component 316 having a shutter space 318 therein. The shutter space 318 of shutter shield component 316 acts as an insulation barrier in dissipating the excessive heat caused by the UV lamp assembly 200.

DETAILED DESCRIPTION OF THE SECOND EMBODIMENT

Overview of Second Embodiment 400

The second embodiment 400 of the present invention is represented in detail by FIGS. 10 through 17. The drying apparatus 400, as shown in FIGS. 1, 10, 11, 13A, and 13B, comprises a shroud assembly 420 for housing the two major component assemblies and parts therein. These two major component assemblies include a UV lamp assembly 600 for drying of lacquer or shellac on the outside wall of a tube 16; and a shutter assembly 680 for keeping the UV lamp assembly 600 ON when there are mechanical problems due to breakdowns, as previously mentioned in the first embodiment. It should be noted that drying apparatus 400 has an enlarged shroud assembly 420 for holding a UV lamp assembly 600 having two UV irradiator lamp assemblies 200' and 200" being connectedly attached; and a shutter assembly 680 having two air compression cylinders 282' and 282" being mounted on the adjacent ends of an outside wall 468 of shroud assembly 420.

Shroud Assembly 420

The shroud assembly 420 of the drying apparatus 400, as depicted in FIGS. 1, 10, 11, 12, 13A, and 13B, includes a substantially rectangular metal shroud housing 422 having an integrally attached front wall 424, rear wall 430, bottom slanted wall 436, bottom wall 442, top slanted wall 448, top wall 454, left sidewall 460 and right sidewall 466. Front wall 424 includes outside and inside surfaces 426 and 428 having openings 472, 474, 484, 476, 478, 486, and 488 for the insertion therein of the UV lamp assembly 400, the upper left and right flange bearings 68' and 68" and flange connecting bolts 70', respectively. Front wall 424 further includes threaded mounting openings 492, 494, 496, and 498 for fixedly connecting upper and lower guide rails 76' and 86' to the inner wall surface 428 via connecting bolts 92'. Guide rails 76' and 86' include inside and outside U-shaped channel tracks 78', 80', 88', and 90' for sliding the UV lamp assembly 400 in and out of the shroud housing 422.

Rear wall 430 includes outside and inside surfaces 432 and 434 having an arc shaped cut-out opening 500 for the passage of the rotatable mandrels 14 through arc 500, and threaded openings 502, 504, 506, and 508 for mounting of the lower left and right flange bearings 68' and 68" to the inside wall surface 434 via connecting bolts 70'. Rear wall 30 further includes threaded mounting openings 510, 512, 514, and 516 for fixedly connecting upper and lower guide rails 76' and 86' to the inner wall surface 434 via connecting bolts 92'.

Bottom wall 436 includes outside and inside surfaces 438 and 440 having a rectangular cut-out opening 520 for the passage of the rotatable mandrels 14 through rectangular opening 520; and a plurality of threaded mounting openings 522 for the bottom front and rear UV light shields 524, 526, 528, and 530. The bottom front UV light shields 524 and 526 have a plurality of mounting openings 532 and 534 for attaching the shields 524 and 526 to the outside surface 440 via connecting bolts 118' in threaded openings 522. Conversely, the bottom rear UV light shields 528 and 530 have a plurality of mounting openings 536 and 538 for attaching the shields 528 and 530 to the outside surface 440 via connecting bolts 118' in threaded openings 522. The top and bottom UV light shields 544, 546, 548, 550, 524, 526, 528, and 530 protect the operator from any escaping UV light rays 270' when the UV lamp assembly 400 is on.

Top wall 448 includes outside and inside surfaces 450 and 452 having a rectangular cut-out opening 540 for the passage of the rotatable mandrels 14 through rectangular opening 540; and a plurality of threaded mounting openings 542 for the top front and rear UV light shields 544, 546, 548, and 550. The top front UV light shields 544 and 546 have a plurality of mounting openings 552 and 554 for attaching the shields 544 and 546 to the outside surface 450 via connecting bolts 118 in threaded openings 542. Conversely, the top rear UV light shields 548 and 550 have a plurality of mounting openings 556 and 558 for attaching the shields 548 and 550 to the outside surface 450 via connecting bolts 118 in threaded openings 542.

Left sidewall 460 includes outside and inside surfaces 462 and 464 having an opening 560 for the sight cover plate 562 and a plurality of threaded mounting openings 566 for fixedly connecting the sight cover plate 562 to the outside surface 462. The sight cover plate 562 includes a plurality of mounting openings 564 for attaching the sight cover plate 562 to the outside surface 462 via connecting bolts 118 in the plurality of threaded mounting openings 566 of left sidewall 460.

Right sidewall 466 includes outside and inside surfaces 468 and 470 having an opening 570 for the exhaust cover plate 572 and a plurality of mounting openings 580 for fixedly connecting the exhaust cover plate 570 to the outside surface 468. The exhaust cover plate 572 includes a plurality of mounting openings 578 for attaching the exhaust cover plate 570 to the outside surface 468 via connecting bolts 118 in the plurality of threaded mounting openings 580 of right sidewall 466. The exhaust cover plate 570 also includes a centrally located exhaust hole opening 574 being four (4") inches in diameter having an integrally attached exhaust hose connector 576 for attaching of an exhaust hose 127' to exhaust out the hot air being generated by UV lamp assembly 600. Right sidewall 466 further includes a plurality of two sets threaded upper and lower mounting openings 582 and 584; and 586 and 588 for fixedly connecting the pivot bracket mounting plates 136' and 136" to the outside surface 468. The pivot bracket mounting plates 136' and 136" includes front and rear wall surfaces 144' and 144" and 146' and 146" having a plurality of upper and lower mounting openings 138' and 138" and 140' and 140" for attaching the plate 136' and 136" to the outside surface 468 via connecting bolts 142 in the plurality of threaded mounting openings 132' and 132" and 134' and 134". The mounting plates 136' and 136" also includes a pair of threaded mounting openings 148' and 148" for fixedly connecting the pivot brackets 284' and 284" to the front wall surface 144' and 144" via connecting bolts 142.

Figure 13A:
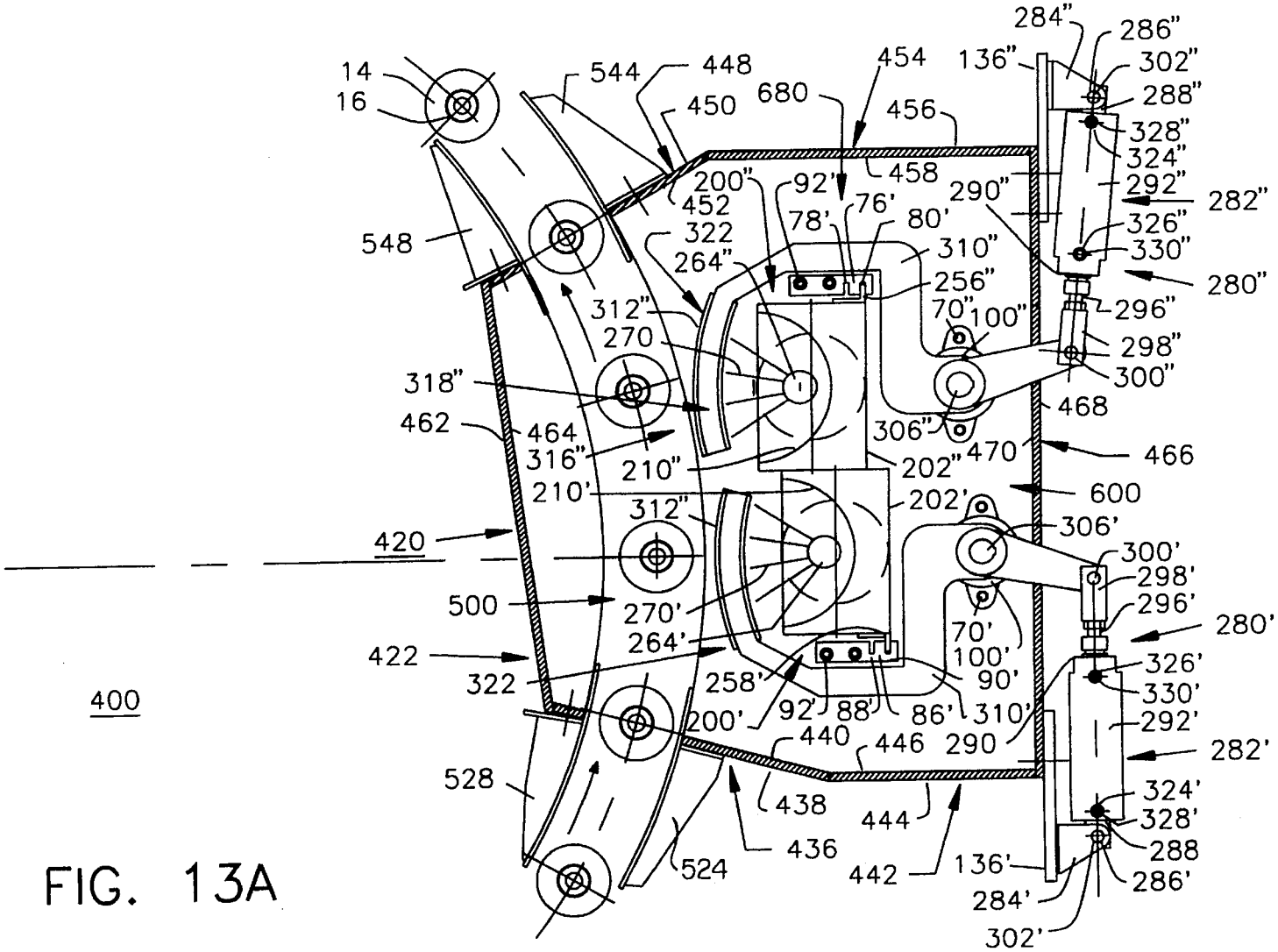
FIG. 13A is a vertical sectional front view of the drying apparatus of the second embodiment, taken along the sectional line B—B of FIG. 11, showing the UV lamp assembly, and shutter assembly contained within the shroud assembly which depicts the interaction of the assemblies in the closed position which prevents the drying process.
Figure 13B:
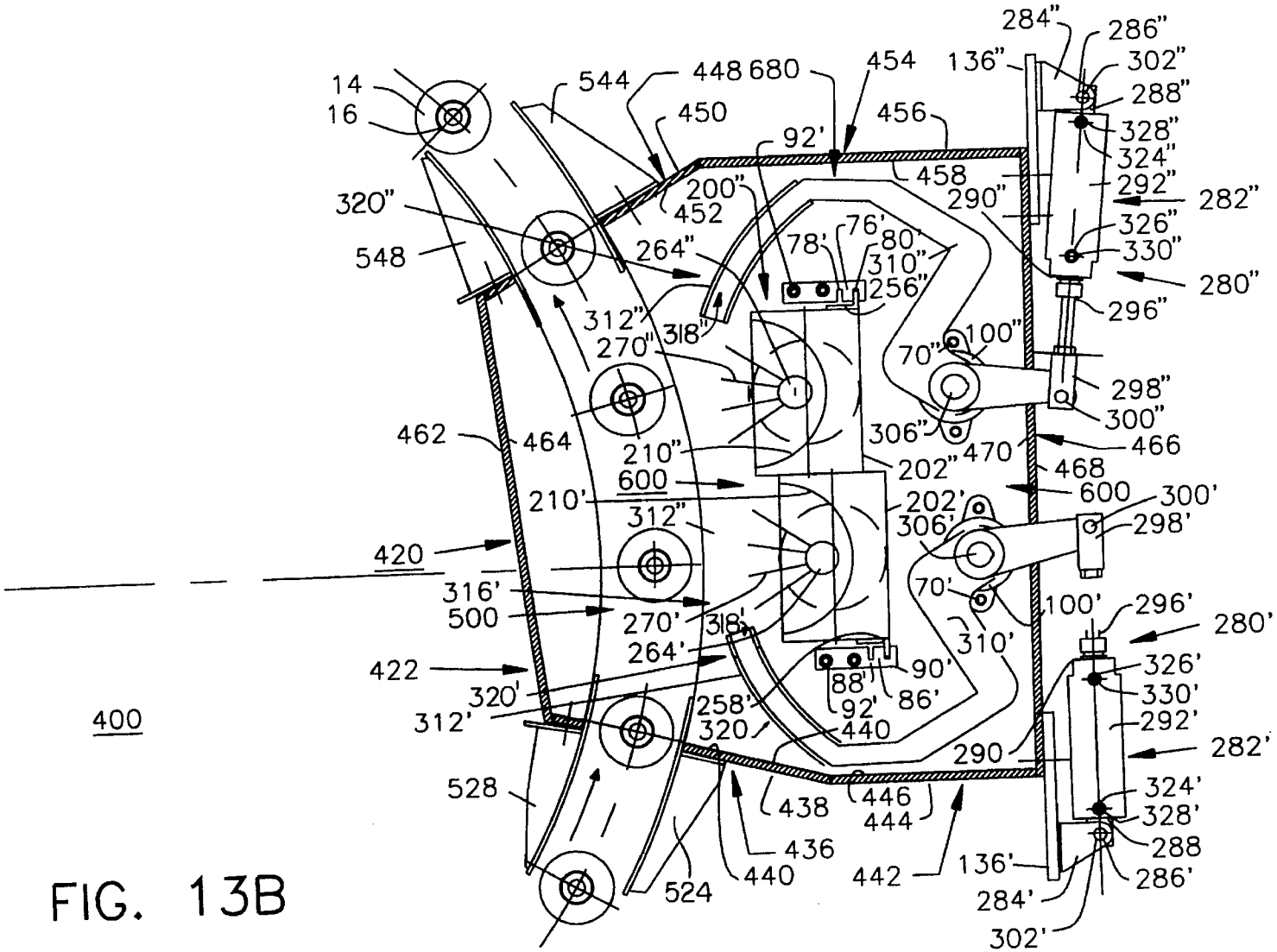
FIG. 13B is a vertical sectional front view of the drying apparatus of the second embodiment, taken along the sectional line B—B of FIG. 11, showing the UV lamp assembly, and shutter assembly contained within the shroud assembly which depicts the interaction of the assemblies in the opened position for drying of the tubes mounted on the plurality of rotatable mandrels passing through the shroud assembly.
Figure 14:
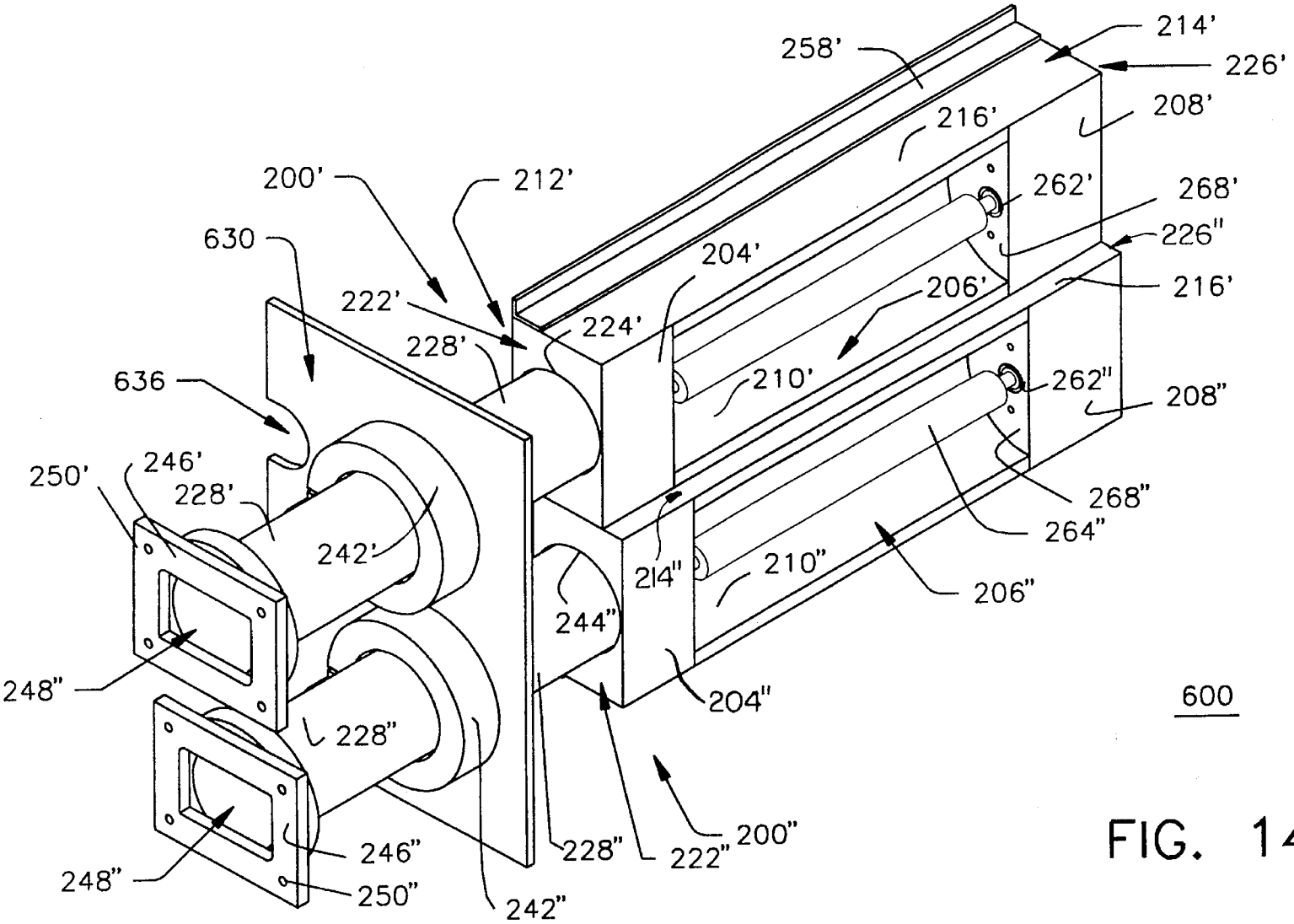
FIG. 14 is a front perspective view of the UV lamp assembly of the second embodiment showing its major component parts in an assembled condition.
Figure 15:
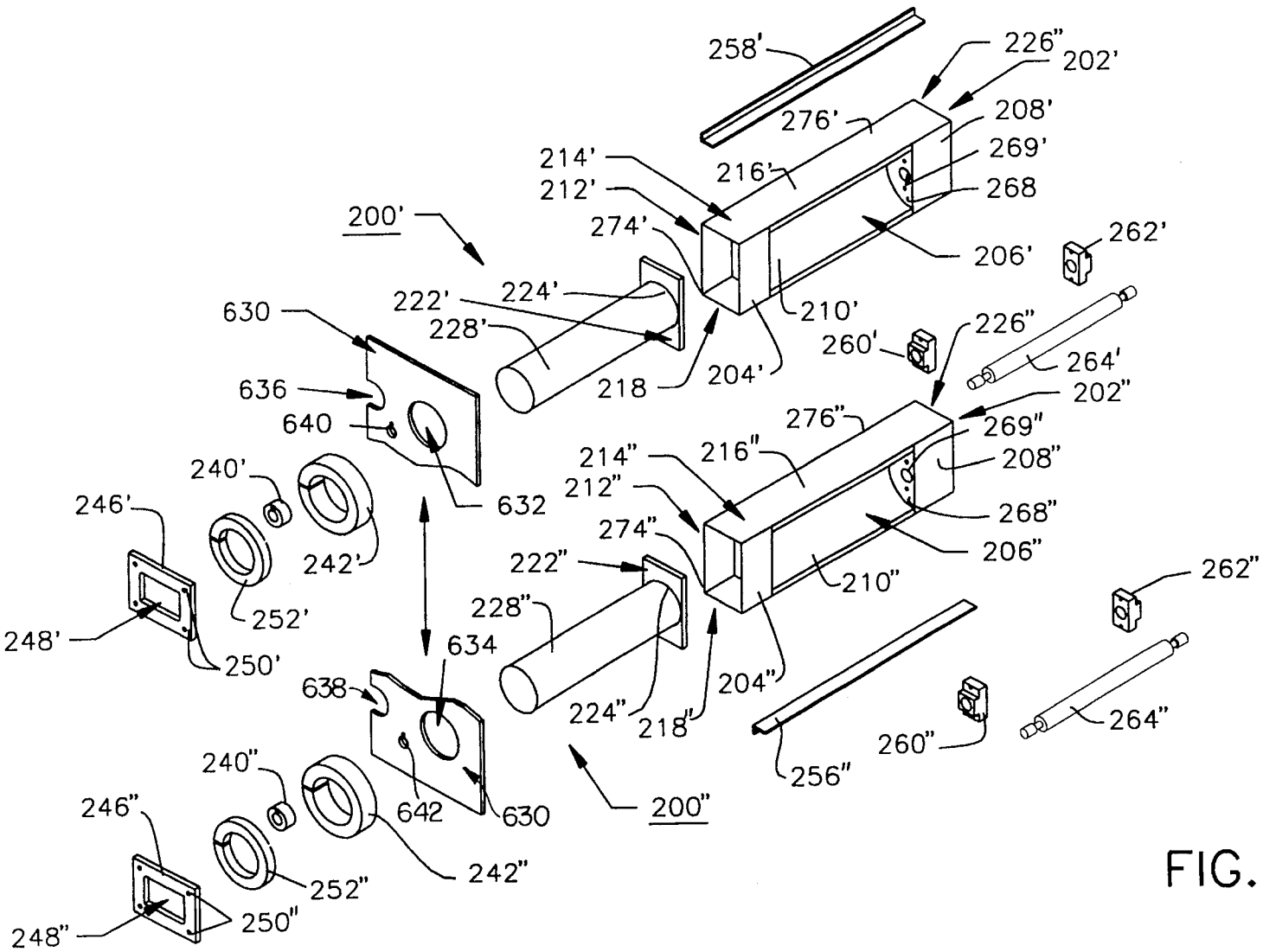
FIG. 15 is an exploded front perspective view of the UV lamp assembly of the second embodiment showing its component parts.
Figure 16:
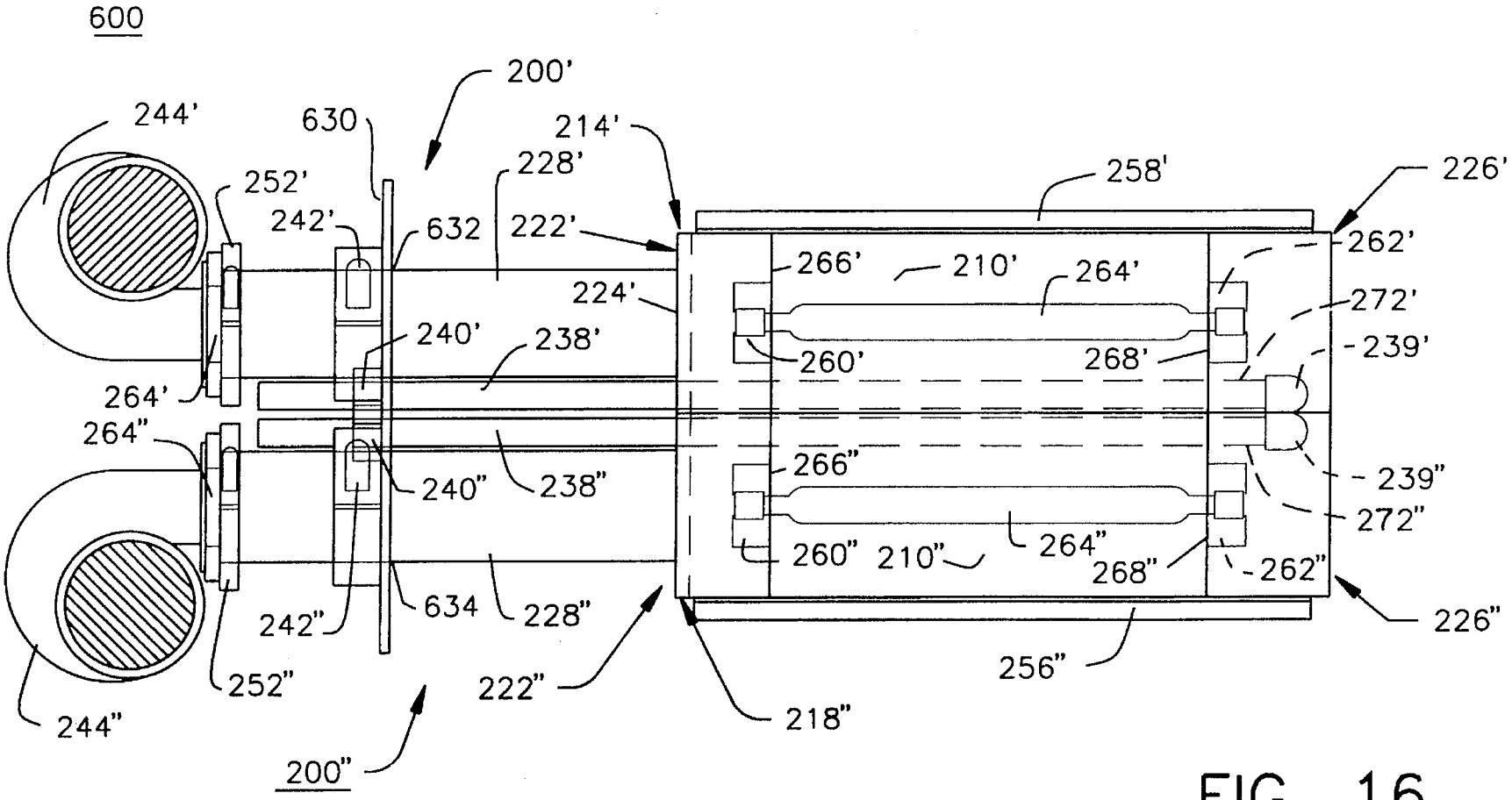
FIG. 16 is a front elevational view of the UV lamp assembly of the second embodiment showing the blower fan, cooling tube, UV lamp bulb and its other component parts in their assembled positions.
Figure 17:
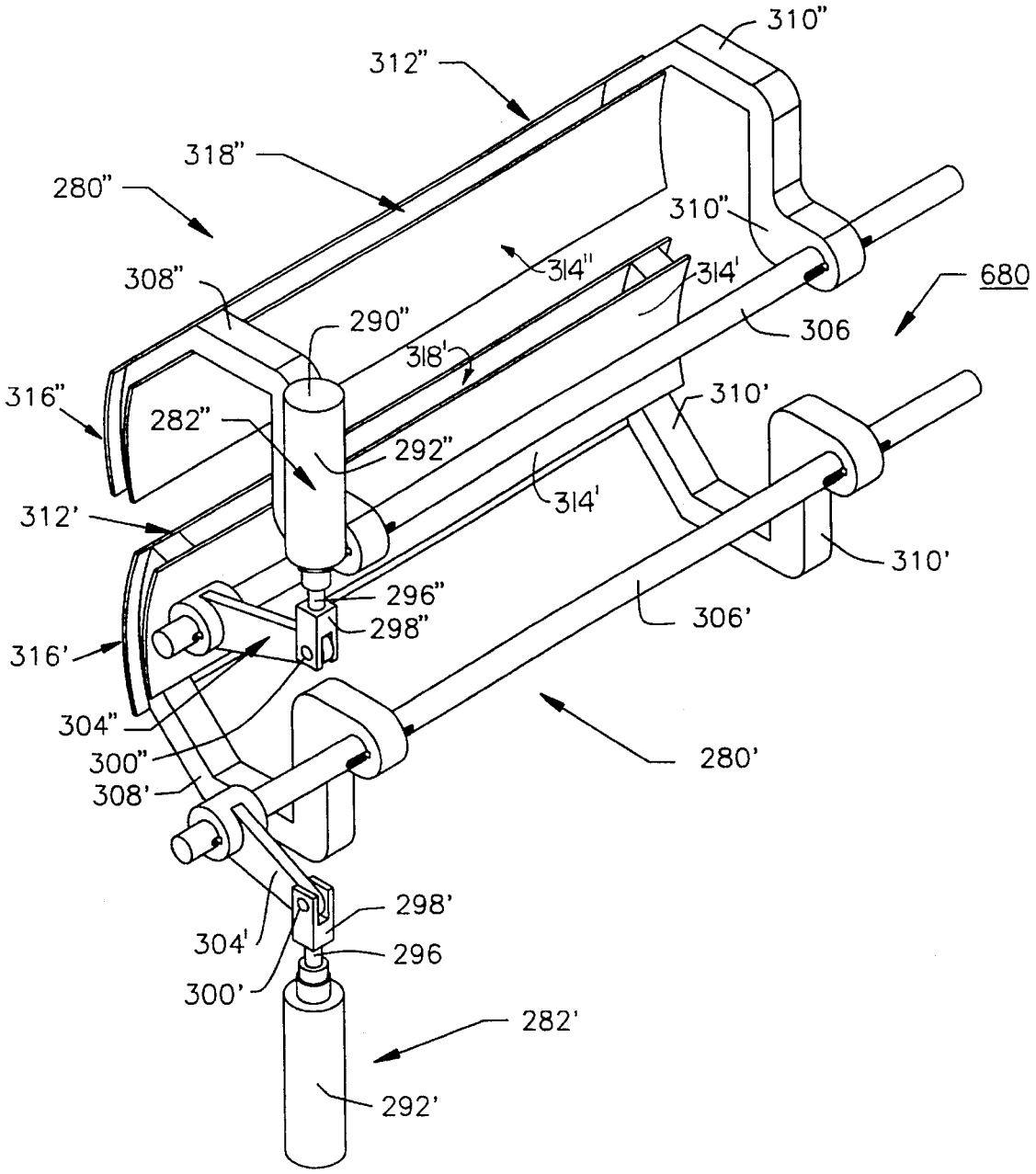
FIG. 17 is a rear perspective view of the shutter assembly of the second embodiment showing its major component parts in an assembled condition.

The main function of shroud assembly 420, as shown in FIGS. 1, 10, 11, 13A, and 13B of the drawings, is to house and protect the UV lamp assembly 600 and protect against any escaping UV light rays 270' and 270". The sight cover plate 562 is solid and not transparent and provides for access to dryer 400 when UV lamp assembly 600 is off and when there is a mechanical problem, i.e. jamming of tubes. Further access to dryer 400 is available by the removal of the larger exhaust cover plate 572. Mounting plates 136' and 136" provide for the connecting points to the air compression cylinders 282' and 282" of shutter assembly 680 and shroud assembly 420, as shown in FIGS. 1, 13A, and 13B of the drawings.

UV Lamp Assembly 600

The UV lamp assembly 600 of the second embodiment for dryer 400 includes two identical UV lamp assemblies 200, as described above. In this second embodiment each of these UV lamp assemblies are designated by the reference numbers 200' and 200" for sake of convenience. The only differences in this second embodiment of UV lamp assembly 600 of dryer 400 are described as follows. Housing assemblies 202' and 202" are connected by bolts, such that the right sidewall 218' of housing 202' is adjacent and slightly off-set rearwardly on the left sidewall 214' of housing 202". As depicted in FIGS. 13A and 13B, housings 202' and 202" are slightly off-set from each other, as to provide UV light 270' and 270" for drying of lacquer or shellac on tube 16 from UV lamps 264' and 264", such that the mandrels 14 are at all times at equal distance from the UV lamps 264' and 264" along the arc passageway 500 which provides for the same amount of heat intensity from the UV light 270' and 270" when drying the aforementioned tubes 16 in dryer 400. The other exception to the duplication of component parts is the front cover plate 630 has cooling tube openings 632 and 634 for cooling tubes 228' and 228", cut-out openings 636 and 638 for cylinder pivot arms 304' and 304", and electrical conduit openings 640 and 642 for electrical conduit 238' and 238".

The principle function of UV lamp assembly 600, as shown in FIG. 1, is to provide for the ultra-violet light for drying of protective coatings, such as lacquer, shellac, or paint on tube 16. The larger shroud assembly 420 and the double UV lamps 264' and 264" within UV lamp assembly of shroud housing 422 provides for a higher intensity of heat for drying for a longer period of time. In all other functions the UV lamp assembly 600 performs in the same manner as the UV lamp assembly 200.

Shutter Assembly 680

The shutter assembly 680 of the second embodiment for dryer 600 includes two identical shutter assemblies 280, as described above. In this second embodiment each of these shutter assemblies are also designated by the reference numbers 280' and 280" for sake of convenience. The only difference in this second embodiment of shutter assembly 680 of dryer 400 is the physical orientation of the two shutter assemblies 280' and 280" within shroud housing 422, as depicted in FIGS. 13A and 13B of the drawings. The shutter assemblies 280' and 280" are oriented such that the shutter shield components 316' and 316" are facing each other in a "clam" fashion when in a closed shutter position 320, as shown in FIGS. 1 and 13A. Also, the air compression cylinders 282' and 282" are located at opposite ends of outer wall surface 468 being mounted on pivot bracket mounting plates 136' and 136", such that there is sufficient room for the stroking of the piston arms 296' and 296" to an outstroke mode which gives the open shutter position 320, as shown in FIG. 13B. In all other respects, the shutter assembly 680 having dual shutter assemblies 280' and 280" performs in the same manner as the shutter assembly 280 of the first embodiment.

METHOD OF OPERATION OF THE FIRST AND SECOND EMBODIMENTS

Before operating dryer apparatus 10 and/or 400 of the first and second embodiments of the present invention, the operator first slides out the UV lamp assemblies 200 and 600 to check and/or service the UV lamp 264, 264', or 264". Then the operator adjusts the position of the UV lamp 264, 264', or 264" relative to the mandrels 14 for varying the heat drying intensity. The UV lamp assemblies 200 and 600 are adjusted by placing them on the inner or outer guide tracks 78 and 88, or 80 and 90, for more or less heat for drying of tubes or containers 16. The operator then next adjusts for the length of the tube 16 being dried. The cooling tube clamps 242, 242', or 242" are loosened and are adjusted on cooling tubes 228, 228', and 228". This allows more or less of the length of the UV lamp 264, 264', or 264" to face the tube if it is longer or shorter than the previous production run. The UV lamp assemblies 200 and 600 are then ready to be slid back into the shroud housings 22 and 422 to begin operation.

Because of the way the shutters 316, 316', and 316" are pivotally mounted on shutter shafts 306, 306', or 306", there is little or no vibration of the shutter assemblies 280 and 680 when they are in operation.

In operation, the operator then actuates pneumatic valve 328, 328', or 328" for supplying outstroke air to the air compression cylinder 282, 282', or 282" which moves the piston arm 296, 296', or 296" to its extended position. This moves the shutter 316, 316', or 316" from a UV light-blocking position 322 between the UV lamps 264, 264', or 264" and tubes 14; as shown in FIGS. 1, 5A, and 13A, to the UV light drying position 320 where the shutter 316, 316', or 316" is moved out of the light path 270, 270', and 270" for drying the ink and/or coatings on tubes 14, as shown in FIGS. 5B and 13B of the drawings. Thus, the shutter 316, 316', or 316" stays in this open position 320 during the continuous operation of a particular size of tube 14.

If there is a particular problem, such as a jam of tube 14, the operator shuts off the mandrel indexing dial 13, and actuates pneumatic valves 330, 330', or 330" for supplying instroke air to the air compression cylinder 282, 282', or 282" which moves the piston arm 296, 296', or 296" to its retracted position. This moves the shutters 316, 316', or 316" from a UV light drying position 320 to a UV light blocking position 322, as shown in FIGS. 1, 5A, and 13A. The UV lamp 264, 264', or 264" does not have to be shut off for servicing the jam or other mechanical problems, as in the prior art apparatus. The operator then opens and removes the sight cover plate(s) 112 or 562, and then inserts his/her arm(s) and unjams the tubes 14 and/or fixes the mechanical problem. The operator then remounts the sight cover plate 112 or 562 to the shroud housing 22 or 422, and the operator then actuates valves 328, 328', or 328" to move the air compression cylinder 282, 282', or 284 to the extended position 320, as previously mentioned, for drying tubes 14. The operator then restarts the mandrel indexing dial 13 to continue the production run in progress.

To service the UV light 264, 264', or 264", the operator shuts off the mandrel indexing dial 13, and moves the air compression cylinder 282, 282' or 284" so piston arms 296, 296', or 296" are retracted, such that shutter 316, 316', or 316" is moved to the closed or light-blocking position to block the UV light from drying tubes 16 on mandrels 14. The operator then releases the housing clamps (not shown) on housings 22 or 422 and slides out the UV lamp assembly 200 or 600 through assembly opening 60 or 472 along guide rails 256 and 258 or 256" and 258'; and guide tracks 80 and 90 or 80' or 90' to a non-operational position outside the shroud assembly 20 or 420. While the UV lamp assembly 200 or 600 is being serviced, another UV lamp assembly 200 or 600 is slid back through the assembly opening 60 or 472 along the aforementioned guide tracks 80 and 90 or 80' or 90' and readied for the operational mode, as previously discussed, thus minimizing down time to the production run currently taking place. The new UV lamp assemblies 200 or 600 having a new UV lamp 264, 264', or 264" can be left in place until service is required or it can be replaced with the recently serviced UV lamp assembly 200 or 600.

Typically, the dryer apparatus 10 of the first embodiment and the dryer apparatus 400 of the second embodiment are used in combination with each other to dry ink or coatings on tubes 16, as depicted in FIG. 1. However, dryer apparatus 10 may be used by itself for drying of ink on tubes 16, and similarly, dryer apparatus 400 may be used by itself for drying of coatings on tubes 16.

Advantages of the Present Invention

Accordingly, it is an advantage of the present invention that it provides for a drying apparatus having an UV light shutter assembly that has a clam-type shutter which is movable, accessible, and UV light leakproof for the drying of printed indicia or coatings on cups, tubes, or containers for dry off-set printing presses.

Another advantage of the present invention is that it provides for a drying apparatus having a UV lamp assembly having the primary benefits of increased efficiency due to lower maintenance, less down time, and less labor costs for repair and replacement of broken UV lamps, and for change-overs to different container and cup sizes.

Another advantage of the present invention is that it provides for a shroud assembly or housing which eliminates any UV light leakage from the UV lamp assembly and which reduces eyesight injury and fatigue of an operator. Thus, the UV lamp assembly is essentially leak proof and does not emit any UV light from the shroud assembly.

Another advantage of the present invention is that it provides for a shroud assembly that is larger, sturdier, not cumbersome, as all of its component parts are readily accessible for easy maintenance, repair, or replacement of broken parts.

Another advantage of the present invention is that it provides for a shutter assembly with an improved mounting arrangement and made of a better quality and heavier gauge steel thereby eliminating machine vibrations which further reduces UV light bulb breakage.

Another advantage of the present invention is that it provides for a UV blower fan located outside of the shroud assembly and adjustable for intensity of air flow to allow the UV fan to dissipate the heat caused by the UV lamp because the shroud housing is larger and the air flow is blowing along the length of the UV lamp. This design allows the UV lamp to last a longer time before burning out.

Another advantage of the present invention is that it provides for a drying apparatus having an UV lamp assembly that easily slides out of the shroud assembly for ease of maintenance and repair of the UV lamp, UV blower fan, UV assembly control box, shutter arm, shutter light shields, etc.

A further advantage of the present invention is that it provides for a shroud assembly having a sight cover plate that is easily removable for the visual inspection of the drying process without injury or damage to the operators' eyesight.

A still further advantage of the present invention is that it provides a drying apparatus that is simple to manufacture and assemble; and is also more cost efficient in operational use than previous drying apparatus.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A dryer apparatus in combination with a printing press for drying printed matter and coatings on containers as they are received from the printing press, comprising:

a) a UV lamp assembly for drying printed matter and coatings on the containers; a shroud assembly for housing said UV lamp assembly;

b) said UV lamp assembly including a housing, a UV lamp mounted in said housing, and a UV reflector mounted in said housing for directing UV light in a light path toward the containers, and means for moving said UV lamp assembly between an operational position in said shroud assembly and a non-operational position outside said shroud assembly to allow said UV lamp to be serviced or changed;

c) a shutter assembly including a shutter and means for pivotally mounting said shutter located inside said shroud assembly for pivotally moving said shutter between a light-blocking position between said UV lamp and the containers, and a light-drying position wherein said shutter is moved out of the light path of said UV lamp to dry the containers, said means for pivotally mounting said shutter are mounted out of the light path of said UV reflector to avoid exposure to direct UV light; and d) said means for moving said UV lamp assembly including guide rails on said UV lamp assembly and guide tracks mounted within said shroud assembly, said guide rails for engaging said guide tracks for moving said UV lamp assembly between said operational and non-operational positions.

2. A dryer apparatus in accordance with claim 1, wherein said means for pivotally mounting said shutter includes bearings mounted on the inside walls of said shroud assembly, and wherein said bearings are mounted behind said UV reflector and out of said light path to avoid exposure to direct UV light.

3. A dryer apparatus in accordance with claim 1, wherein said means for pivotally mounting said shutter includes piston-cylinder means mounted outside said shroud assembly and having a pivot arm for activating said means for pivotally mounting said shutter to move said shutter between said light-blocking position and said light-drying position.

4. A dryer apparatus in accordance with claim 1, further including electrical connection means having an electrical conduit connected to a power source to supply electrical power to said UV lamp assembly, and said electrical conduit being connected to and movable with said UV lamp assembly.

5. A dryer apparatus in accordance with claim 1, further including a blower fan connected to a cooling tube for transferring cooled air to said UV lamp assembly, and exhaust means for exhausting hot air from said shroud assembly.

6. A dryer apparatus in accordance with claim 1, wherein said shutter is U-shaped and has an light-blocking shutter wall for moving between said UV lamp and the containers and a pair of legs connected to said means for pivotally mounting said U-shaped shutter.

7. A dryer apparatus in accordance with claim 1, wherein said means for moving said UV lamp assembly includes means for sliding said UV lamp assembly between said operational and non-operational positions.

8. A dryer apparatus in accordance with claim 1, wherein said shutter includes an inner and outer shutter shield separated by an air gap to form an insulation barrier for dissipating excessive heat from said UV lamp assembly.

9. A dryer apparatus in accordance with claim 1, wherein said shroud assembly includes a housing having a first opening formed therein through which said UV lamp assembly moves between said operational position in said housing and said non-operational position outside of said housing, and a passageway extending through said housing through which the containers pass to be dried.

10. A dryer apparatus in accordance with claim 9, further including a first cover plate for covering said first opening to prevent the leakage of UV light from said housing.

11. A dryer apparatus in accordance with claim 10, further including a cooling tube for transferring cooled air to said UV lamp assembly.

12. A dryer apparatus in accordance with claim 10, further including a second cover plate for covering a second opening in said housing to provide access for repair or service.

13. A dryer apparatus in combination with a printing press for drying printed matter and coatings on containers as they are received from the printing press, comprising:

a) two UV lamp assemblies for drying printed matter and coatings on the containers; a shroud assembly for housing said two UV lamp assemblies;

b) each of said UV lamp assemblies including a housing, a UV lamp mounted in said housing, and a UV reflector mounted in said housing for directing UV light in a light path toward the containers, and means for moving said two UV lamp assemblies between an operational position in said shroud assembly and a non-operational position outside said shroud assembly to allow said UV lamps to be serviced or changed;

c) two shutter assemblies each including a shutter and means for pivotally mounting said shutter located inside said shroud assembly for pivotally moving each of said shutters between a light-blocking position between said UV lamp and the containers, and a light-drying position wherein each of said shutters is moved out of the light path of said UV lamp to dry the containers, said means for pivotally mounting said shutter are mounted out of the light path of said UV reflector to avoid exposure to direct UV light; and d) said means for moving said UV lamp assemblies including guide rails on said UV lamp assemblies and guide tracks mounted within said shroud assembly, said guide rails for engaging said guide tracks for moving said UV lamp assemblies between said operational and non-operational positions.

14. A dryer apparatus in accordance with claim 13, wherein said means for pivotally mounting each of said shutters includes bearings mounted on the inside walls of said shroud assembly, and wherein said bearings are mounted behind said UV reflector and out of said light path to avoid exposure to direct UV light.

15. A dryer apparatus in accordance with claim 13, wherein said means for pivotally mounting said shutter includes piston-cylinder means mounted outside said shroud assembly and having a pivot arm for activating said means for pivotally mounting each of said shutters to move said shutters between said light-blocking position and said light-drying position.

16. A dryer apparatus in accordance with claim 13, further including electrical connection means having an electrical conduit connected to a power source to supply electrical power to each of said UV lamp assemblies, and said electrical conduit being connected to and movable with said two UV lamp assemblies.

17. A dryer apparatus in accordance with claim 13, further including a blower fan connected to a cooling tube for transferring cooled air to each of said UV lamp assemblies; and exhaust means for exhausting hot air from said shroud assembly.

18. A dryer apparatus in accordance with claim 13, wherein each of said shutters is U-shaped and has an light-blocking shutter wall for moving between said UV lamp and the containers and a pair of legs connected to said means for pivotally mounting each of said U-shaped shutters.

19. A dryer apparatus in accordance with claim 13, wherein said shroud assembly includes a housing having a first opening formed therein through which said UV lamp assemblies move between said operational position in said housing and said non-operational position outside of said housing, and a passageway extending through said housing through which the containers pass to be dried.

20. A dryer apparatus in accordance with claim 13, wherein said means for moving each of said UV lamp assemblies includes means for sliding each of said UV lamp assemblies between said operational and non-operational positions.

21. A dryer apparatus in accordance with claim 13, wherein said shutter includes an inner and outer shutter shield separated by an air gap to form an insulation barrier for dissipating excessive heat from said UV lamp assembly.

22. A dryer apparatus in accordance with claim 19, further including a first cover plate for covering said first opening to prevent the leakage of UV light from said housing.

23. A dryer apparatus in accordance with claim 22, further including two cooling tubes for transferring cooled air to each of said UV lamp assemblies.

24. A dryer apparatus in accordance with claim 22, further including a second cover plate for covering a second opening in said housing to provide access for repair or service.

* * * * *